US007525876B2

(12) United States Patent
Tanjima et al.

(10) Patent No.: US 7,525,876 B2
(45) Date of Patent: Apr. 28, 2009

(54) ELECTRONIC APPARATUS AND PRINTER HAVING CLOCK FUNCTIONS AND CONTROL PROGRAM FOR THE SAME ELECTRONIC APPARATUS STORED IN COMPUTER-READABLE MEDIUM

(75) Inventors: Naoki Tanjima, Nisshin (JP); Hidekazu Ishii, Aisai (JP); Nako Yoshimura, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 11 days.

(21) Appl. No.: 11/653,677

(22) Filed: Jan. 16, 2007

(65) Prior Publication Data

US 2007/0183267 A1 Aug. 9, 2007

(30) Foreign Application Priority Data

Feb. 3, 2006 (JP) ..... 2006-026618

(51) Int. Cl.
*G04B 47/00* (2006.01)

(52) U.S. Cl. ..... 368/10; 368/82

(58) Field of Classification Search ..... 368/82, 368/62, 10; 346/20, 80, 82, 83, 84
See application file for complete search history.

(56) References Cited

U.S. PATENT DOCUMENTS 3,961,472 A * 6/1976 Riehl ..... 368/29
5,734,597 A 3/1998 Molnar et al.
6,061,303 A * 5/2000 Gauthier et al. ..... 368/10
6,286,928 B1 * 9/2001 Kasamatsu ..... 347/23
6,714,486 B2 * 3/2004 Biggs ..... 368/82

FOREIGN PATENT DOCUMENTS

| | | |
|---|---|---|
| CH | 118575 | 3/1927 |
| FR | 2331827 | 6/1977 |
| JP | 55026482 | 2/1980 |
| JP | 628 4236 | 10/1994 |

* cited by examiner

*Primary Examiner*—Renee Luebke
*Assistant Examiner*—Jason Collins
(74) *Attorney, Agent, or Firm*—Day Pitney LLP

(57) ABSTRACT

The electric apparatus performs time display that is optimal for a user, without need of operations for switching time display by use of the 12-hour system and 24-hour system. In a tape printer, a keyboard section and a CPU are connected to each other via any one of a plurality of solder points A, B, and C. If the solder point is "A" (YES at S103), an hour system flag is set to "OFF" (S105). If the solder point is not "A" (NO at S103), the hour system flag is set to "ON" (S107). If the hour system flag is OFF, a target country (target district) of the keyboard section is "USA", so that time is displayed in the 12-hour system on a liquid crystal display section, while if the hour system flag is ON, the target country (target district) of the keyboard section is not "USA", so that time is displayed in the 24-hour system on the liquid crystal display section.

18 Claims, 27 Drawing Sheets

FIG. 7

123a

- P／A HH：MM
- P／A HH：MM：SS
- HH：MM P／A
- MM／DD P／A HH：MM
- MM／DD P／A HH：MM：SS
- MM／DD HH：MM P／A
- HH：MM
- HH：MM：SS
- HH：MM
- MM／DD HH：MM
- MM／DD HH：MM：SS
- MM／DD HH：MM

ELECTRONIC APPARATUS AND PRINTER HAVING CLOCK FUNCTIONS AND CONTROL PROGRAM FOR THE SAME ELECTRONIC APPARATUS STORED IN COMPUTER-READABLE MEDIUM

This application claims priority from JP 2006-026618, filed Feb. 3, 2006, the entire disclosure of which is incorporated herein by reference thereto.

BACKGROUND OF THE INVENTION

1. Field of the Invention

The disclosure relates to an electronic apparatus and a printer that have clock functions and, more specifically, to those that control time display by use of the 12-hour system and the 24-hour system.

2. Description of the Related Art

Conventionally, a variety of electronic apparatuses such as a facsimile, a printer, a TV set, and a personal computer have built in it a so-called clock IC, etc. to measure time, thereby achieving various functions such as display of a current date and time and setting of a reservation timer. Generally, there are two types of hour systems used in these electronic apparatuses, that is, the 12-hour system (e.g., 2:00 p.m.) and the 24-hour system (e.g., 14:00). Also, generally, either of these two hour systems to display time is set beforehand in each of these electronic apparatuses.

Whether the 12-hour system or the 24-hour system for time display is preferred by a user depends on an area where the user lives. Specifically, it is known that Americans and Canadians like the 12-hourtime display system. Therefore, generally hour system that is optimal for time display at the destination of the relevant electronic apparatus is set beforehand when it is manufactured.

Further, as a technology to switch time display by means of the clock functions, a facsimile apparatus is known which is equipped with a switch to make switchover between the standard time and the summer time so that each time this switch is operated, the time setting may be advanced or delayed by one hour, which is disclosed in Japanese Patent Application Laid Open Publication No. HEI 6-284236. In this facsimile apparatus, operations of an operator can be simplified to easily switch between the standard time and the summer time.

SUMMARY OF THE INVENTION

However, in the case of an electronic apparatus having the conventional clock functions, if a user does not like the hour system for time display that is employed in this apparatus, it has been necessary for the user to switch the hour system by performing predetermined operations in this apparatus, which has been inconvenient for the user. On the other hand, to set previously an optimal hour system for time display in electronic apparatuses when they are manufactured, i.e., before shipment thereof, it has been necessary to set the time-display hour system that is optimal for a destination of each of the apparatuses, which has been inconvenient for the manufacturers.

Further, as can be seen from an invention disclosed in Japanese Patent Application Laid Open Publication No. HEI 6-284236, there may possibly be another technique in which an electronic apparatus is equipped with a switch to make the switchover between the time display systems by means of clock functions so that the 12-hour system and the 24-hour system may be switched from each other as this switch is operated. However, equipment of such a time display selecting switch leads to a problem of an increase in labor and cost required in manufacturing of the electronic apparatuses. Further, switchover to an optimal hour system for time display brings regarding a problem that the user or the manufacturer must operate the switch as necessary.

To solve these problems, the electric apparatus, printer and control program have been developed, and it is an object to provide an electronic apparatus and a printer that have clock functions which can display time in an hour system that is optimal to a user without a need of operations required to switch between the 12-hour time display system and the 24-hour time display system.

To achieve this object, according to a first aspect, an electronic apparatus having clock functions comprises a time measurement device that measures time, a time display device that displays time measured by the time measurement device, a service environment identification device that identifies an environment in which the electronic apparatus is to be used, an hour system selection device that selects either the 12-hour system or the 24-hour system for time display based on the environment identified by the service environment identification device, and a time display control device that causes the time display device to display the time measured by the time measurement device in accordance with the hour system selected by the hour system selection device.

According to a second aspect, an electronic apparatus having clock functions comprises a time measurement device that measures time, a time display device that displays time measured by the time measurement device, and a control device that identifies an environment in which the electronic apparatus is to be used, selects either the 12-hour system or the 24-hour system for time display based on the service environment identified, and causes the time display device to display the time measured by the time measurement device in accordance with the hour system selected.

According to a third aspect, a control program for an electronic apparatus having clock functions recorded in a computer-readable medium comprises a time measurement step of measuring time, a service environment identification step of identifying an environment in which the electronic apparatus is to be used, an hour system selection step of selecting either the 12-hour system or the 24-hour system for time display based on the service environment identified by the service environment identification step, and a time display control step of causing the time measured by the time measurement step to be displayed in accordance with the hour system selected by the hour system selection step.

BRIEF DESCRIPTION OF THE DRAWINGS

Exemplary embodiments of the invention will be described below in detail with reference to the accompanying drawings in which:

FIG. 7 is a schematic diagram illustrating a configuration of a 12-hour-system format storage area;

DESCRIPTION OF THE PREFERRED EMBODIMENTS

The following will describe a first embodiment of the disclosure with reference to drawings. First, an overall configuration of a tape printer 1 is described with reference to FIG. 1.

Figure 1:
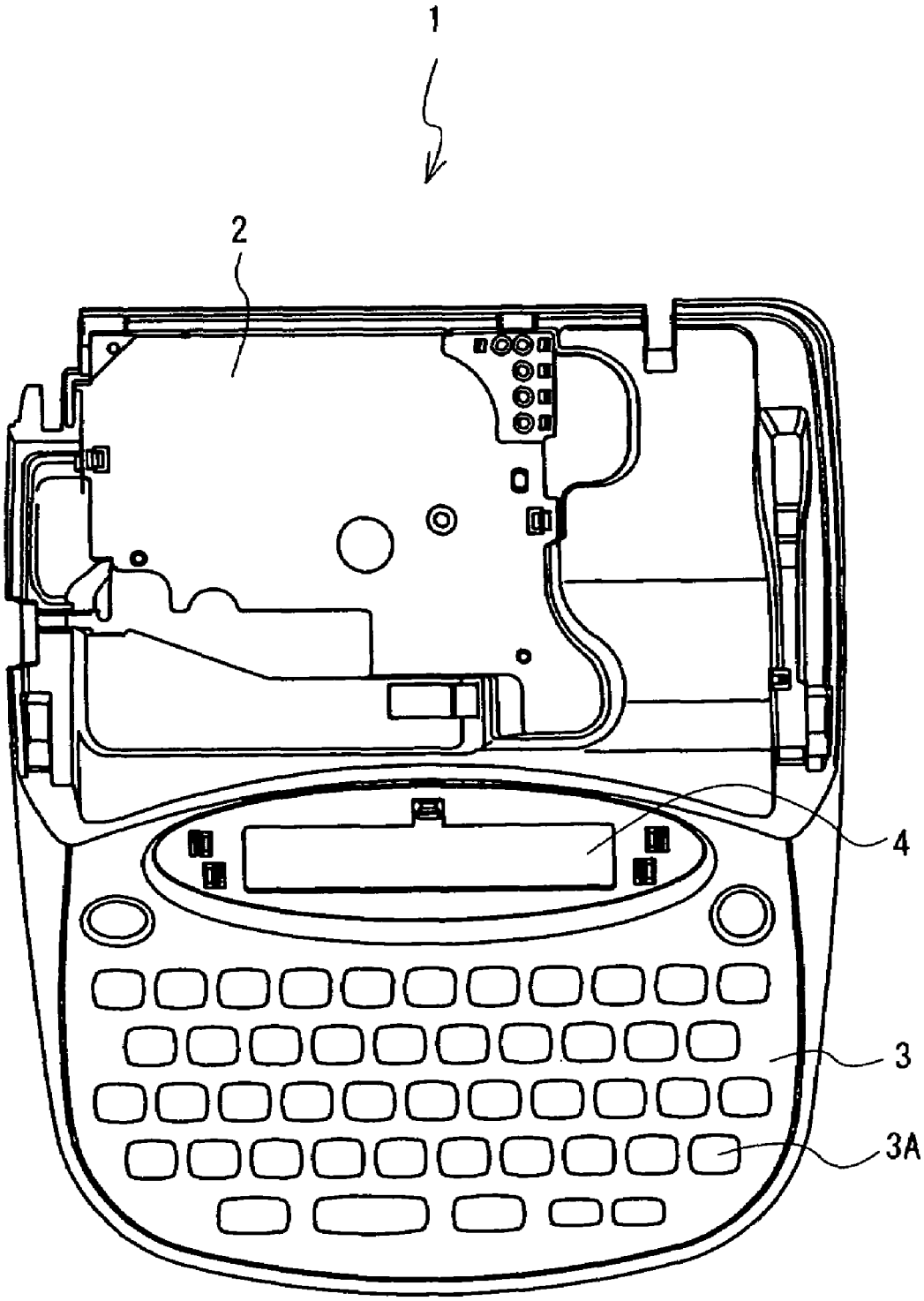
FIG. 1 is a plan view of a tape printer in a first embodiment of the disclosure in a condition where a cover of its tape housing section has been removed.

As shown in FIG. 1, on a rear side of the tape printer 1, a tape cassette housing section 2 is provided which is a concave section for housing a later-described tape cassette 51 (see FIG. 2). On the other hand, on a front side of the tape printer 1, a keyboard section 3 is provided to enter letters and symbols. Through the keyboard section 3, a plurality of keys 3A to enter letters, symbols, and functions are arrayed. Further, between the tape cassette housing section 2 and the keyboard section 3, a liquid crystal display (LCD) section 4 is arranged so as to enable display of letters, symbols, etc. entered through the keyboard section 3.

Next, a structure of the tape cassette 51 mounted into the tape cassette housing section 2 of the tape printer 1 is described with reference to FIGS. 2-4.

Figure 2:
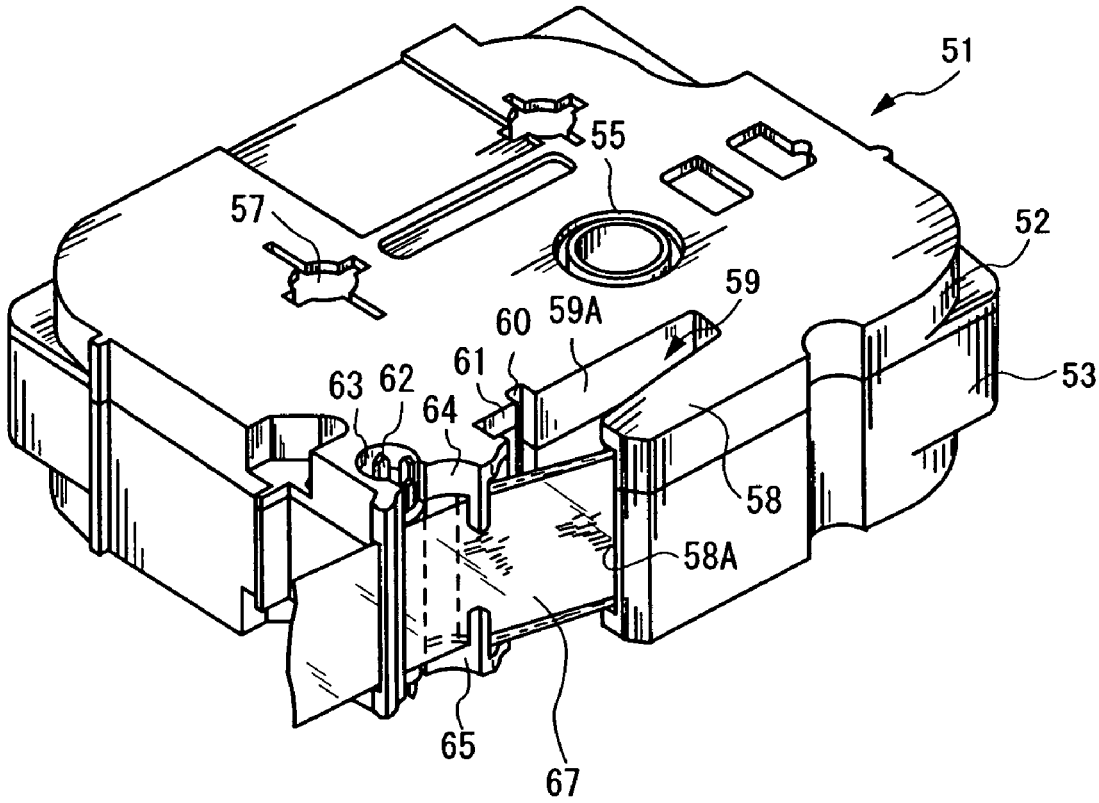
FIG. 2 is a perspective view of a tape cassette.
Figure 3:
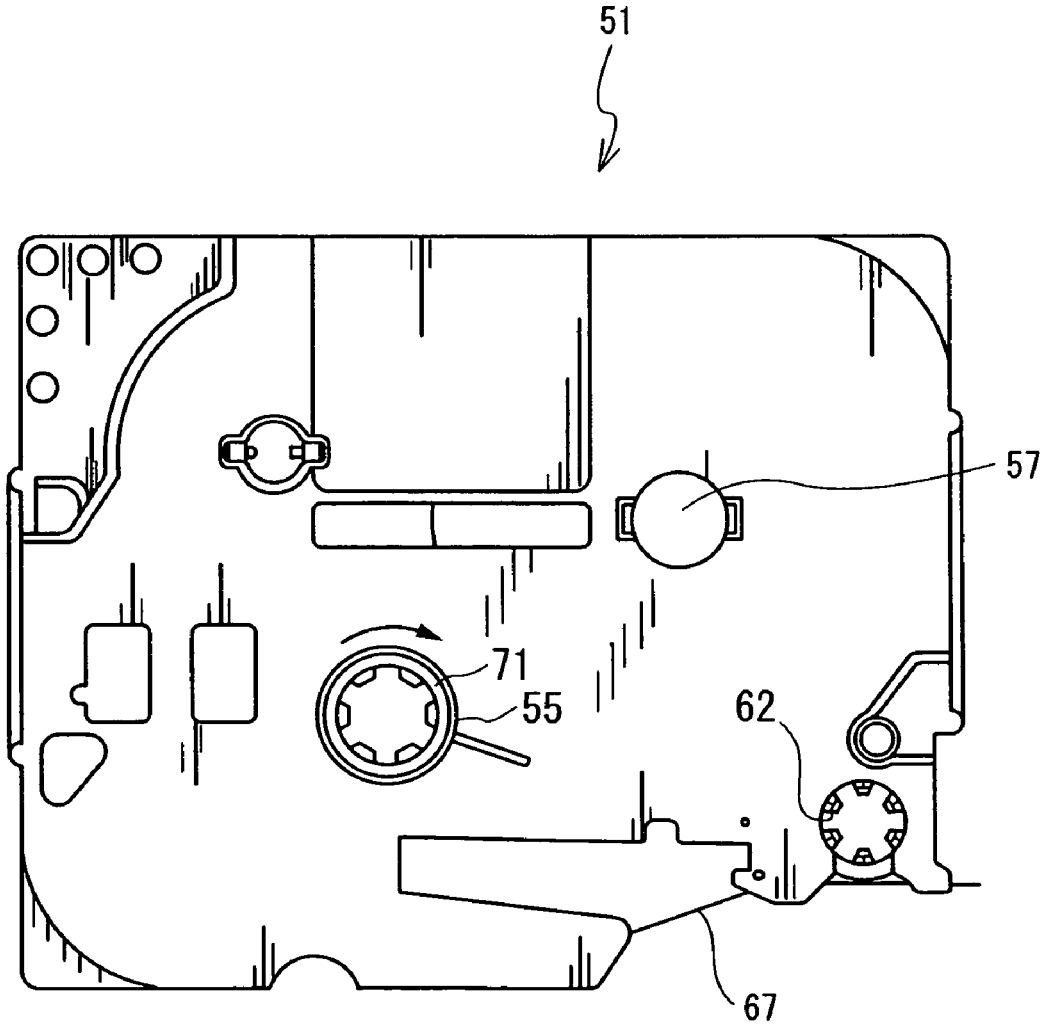
FIG. 3 is a bottom view of the tape cassette.
Figure 4:
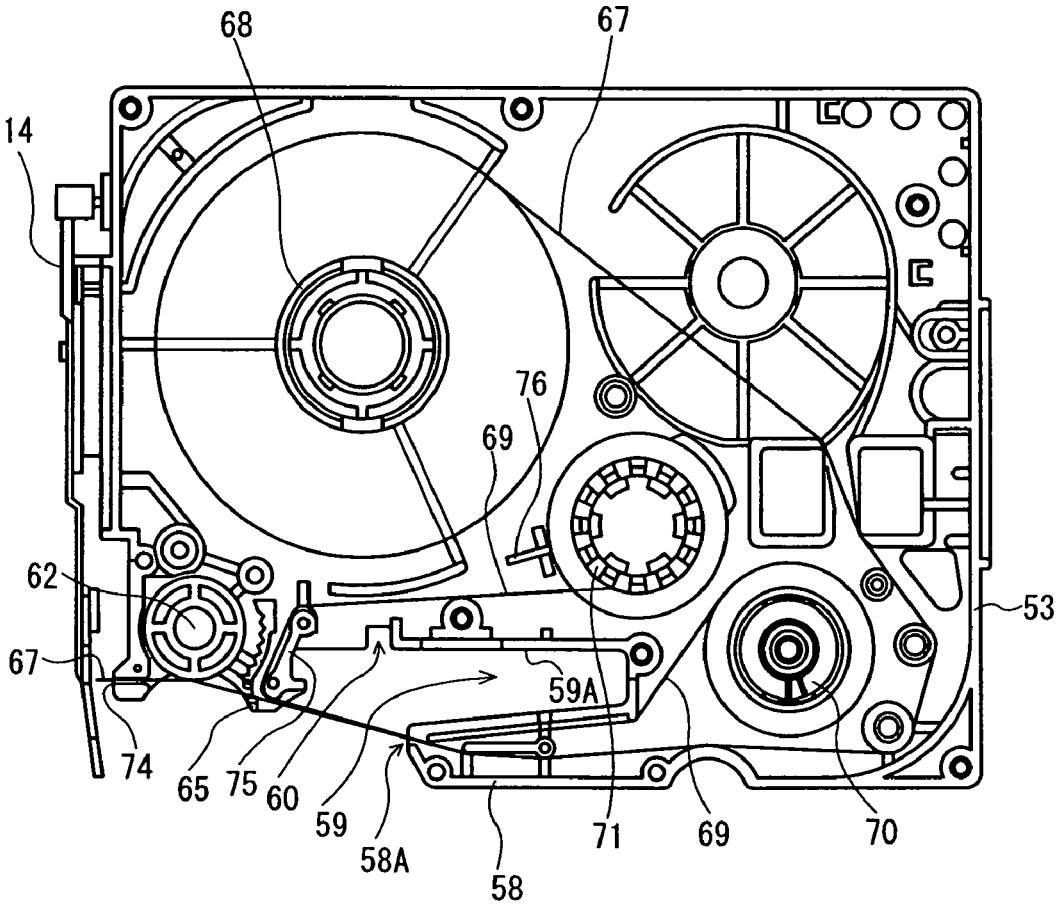
FIG. 4 is a plan view of a lower case in a condition where an upper case has been removed.

As shown in FIGS. 2-4, the tape cassette 51 is comprised of an upper case 52 and a lower case 53. In the tape cassette 51, later-described support holes 57 and 55 are formed. The support hole 57 serves to support a tape spool 68 in a swinging manner around which release paper of a print tape 67 is wound toward an outside. Further, the support hole 55 supports a ribbon take-up spool 71 which pulls an ink ribbon 69 out of a ribbon spool 70 and takes it up when letters, etc. are printed by use of a thermal head (not shown) on the print tape 67. It should be noted that in the lower case 53 also, support holes 55 and 57 are formed in such a manner as to face the support holes 55 and 57 formed in the upper case 52 respectively.

On a front side (lower side in FIG. 2) of the tape cassette 51, an arm section 58 is provided which guides the print tape 67 pulled out of the tape spool 68 and the ink ribbon 69 pulled out of the ribbon spool 70 and sends them out through an opening 58A. Behind the arm section 58, a head mounting section 59 is provided to which the thermal head of the tape printer 1 is mounted.

Further, in the head mounting section 59, in a wall section 59A which faces the arm section 58, a first engagement section 60 is formed which caves in toward a rear side of the tape cassette 51. Also, in a left-side wall in the head mounting section 59, a second engagement section 61 is formed which caves in a direction that is orthogonal to the first engagement section 60 (direction along the wall section 59A). When engaged respectively with two prongs formed on a head holder, not shown, which supports the thermal head, the first engagement section 60 and the second engagement section 61 serve to certainly mount the thermal head to the head mounting section 59 without being blockaded by the ink ribbon 69 or the print tape 67.

Furthermore, with respect to traveling directions of the ink ribbon 69 and the print tape 67, on the downstream side of the head mounting section 59, a tape feed roller 62 is supported in a support hole 63 in such a manner that it can swing. This tape feed roller 62 cooperates with a pressure roller, not shown, which is pressured by the facing tape feed roller 62, to pull the print tape 67 out of the tape spool 68. Also, in the vicinity of the tape feed roller 62, a pair of restriction members 64 and 65 are provided which serve to restrictively guide the print tape 67 having letters, etc. printed thereon in a width direction on the downstream side of the thermal head.

Next, an internal structure of the tape cassette 51 is described. As shown in FIG. 4, inside the tape cassette 51, at a rear part of the lower case 53 (upper part of FIG. 4), the tape spool 68 around which the print tape 67 is wound is arranged via the support hole 57 in such a manner that it can swing. Also, at a front part of the lower case 53 (lower part of FIG. 4), the ribbon spool 70 around which the ink ribbon 69 is wound is arranged in such a manner that it can swing. Further, the ribbon take-up spool 71 which pulls the ink ribbon 69 out of the ribbon spool 70 and takes it up as it is consumed by printing of letters, etc. is arranged between the tape spool 68 and the ribbon spool 70 via the support hole 55 in such a manner that it can swing.

The print tape 67 is pulled out of the tape spool 68 by the above-described cooperation of the tape feed roller 62 and the pressure roller, not shown, which is provided on the side of the tape printer 1, and passes through the front side (lower side of FIG. 4) of the head mounting section 59 from the opening 58A in the arm section 58 and then is discharged from a tape discharge section 74 to the outside of the tape cassette 51.

Also, on the side of a cassette mounting section 9, a cutter mechanism 14 is arranged which cuts the print tape 67 as it is discharged from the tape discharge section 74. The cutter mechanism 14 has a fixed blade, not shown, and a movable blade, not shown, which can swing in such a manner as to come in contact with the fixed blade and go away from it. When driven by a cutter drive circuit 110 (see FIG. 5), the movable blade swings so as to enable cutting off the print tape 67 as it is discharged from the tape discharge section 74 by the principle of a pair of scissors.

On the other hand, the ink ribbon 69 is pulled out of the ribbon spool 70 via the ribbon take-up spool 71, passes through the front side of the head mounting section 59 from the opening 58A in the arm section 58, and then guided by a guide section 75 formed inside each of the restriction members 64 and 65, where it is wound up around the ribbon take-up spool 71. It should be noted that a clutch spring 76 is attached to a lower part of the ribbon take-up spool 71, so as to prevent the ink ribbon 69 from loosening as it is wound around the ribbon take-up spool 71 when it is reversed in rotation.

Next, an electrical configuration of the tape printer 1 is described with reference to FIGS. 5-10.

Figure 5:
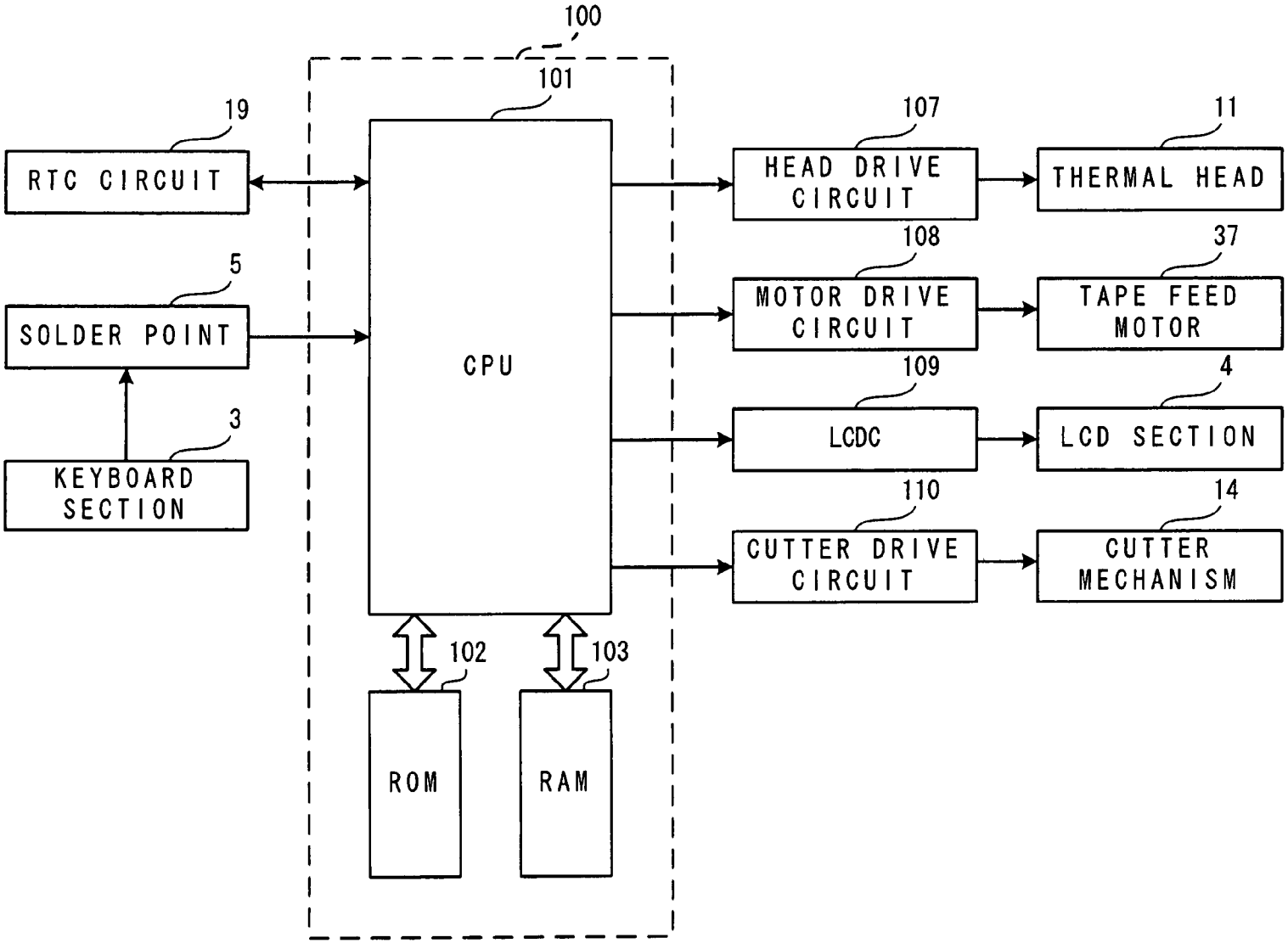
FIG. 5 is a block diagram illustrating a control configuration of the tape printer.

As shown in FIG. 5, the tape printer 1 comprises a control device 100 having a CPU 101, a ROM 102, and a RAM 103. To this CPU 101 are connected the above-described keyboard section 3, a real time clock (RTC) circuit 19 which serves as an oscillation circuit to measure time, a head drive circuit 107 to drive a thermal head 11, a motor drive circuit 108 to drive a tape feed motor 37, a display controller, not shown, (hereinafter referred to as LCDC) 109 having a video RAM to output display data to the LCD section 4, and the cutter drive circuit 110 to drive the cutter mechanism 14. It should be noted that the keyboard section 3 is connected to the CPU 101 via solder points 5, which are a circuit pattern required to change settings formed beforehand on a printed circuit board (PCB) of the control device 100, details of which are described later.

Figure 6:
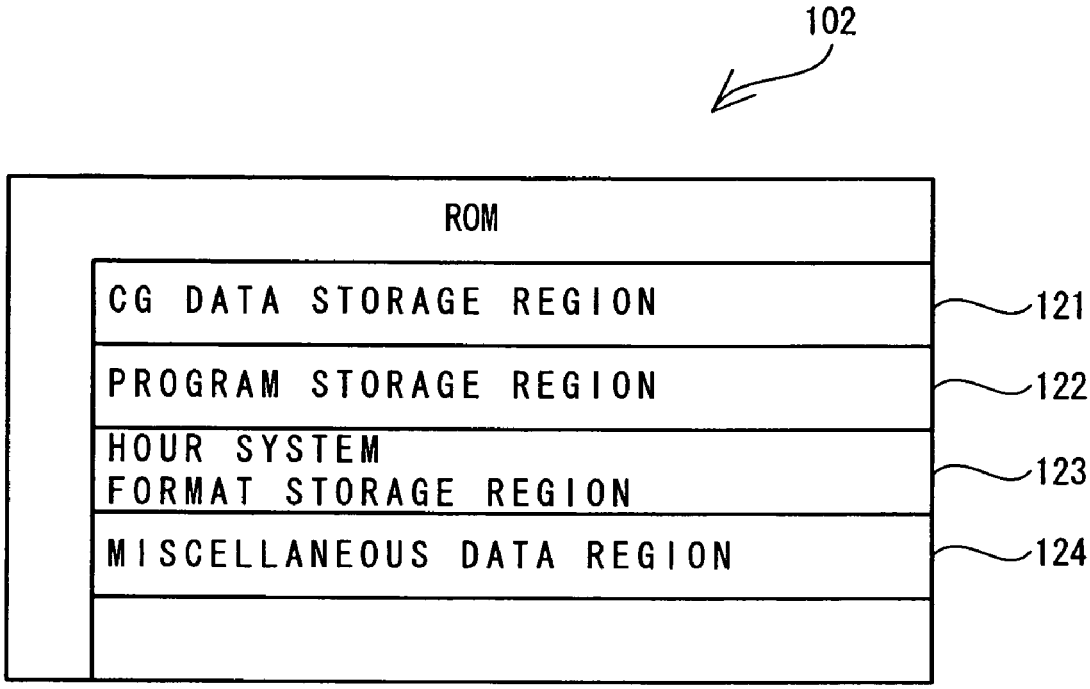
FIG. 6 is a schematic diagram of a configuration of a ROM.

As shown in FIG. 6, the ROM 102 is provided with a CG data storage region 121, a program storage region 122, an hour system format storage region 123, and a miscellaneous data region 124. In the CG data storage region 121, printing dot pattern data of a large number of characters such as alphabets and symbols to be typed is classified for each of typefaces (such as Gothic typeface and Mincho typeface) and stored corresponding to code data as much as six sizes of letters to be typed (16-dot size, 24-dot size, 32-dot size, 48-dot size, 64-dot size, and 96-dot size) for each of the typefaces. Also, graphic pattern data is stored which is required to print a graphic image.

The program storage region 122 stores a display drive control program which controls the LCDC 109 corresponding to code data of characters such as letters and numerals entered through the keyboard section 3, a print drive control program which reads data from a print buffer 132 (see FIG. 9) and drives the thermal heads 11 and the tape feed motor 37, and a variety of other programs required to control the tape printer 1. This CPU 101 performs various kinds of operations based on these programs stored in this ROM 102. It should be noted that a main control program required to perform later-described main processing (see FIG. 11) is also stored in the program storage region 122.

Further, the hour system format storage region 123 stores a plurality of formats which are used to print time measured by the RTC circuit 19 on a tape or to display it on the LCD section 4. The present embodiment provides for a 12-hour system format required for time display (time printing) by use of the 12-hour system and a 24-hour system format required for time display (time printing) by use of the 24-hour system because the 12-hour system and the 24-hour system for time display (time printing) can be utilized.

Figure 8:
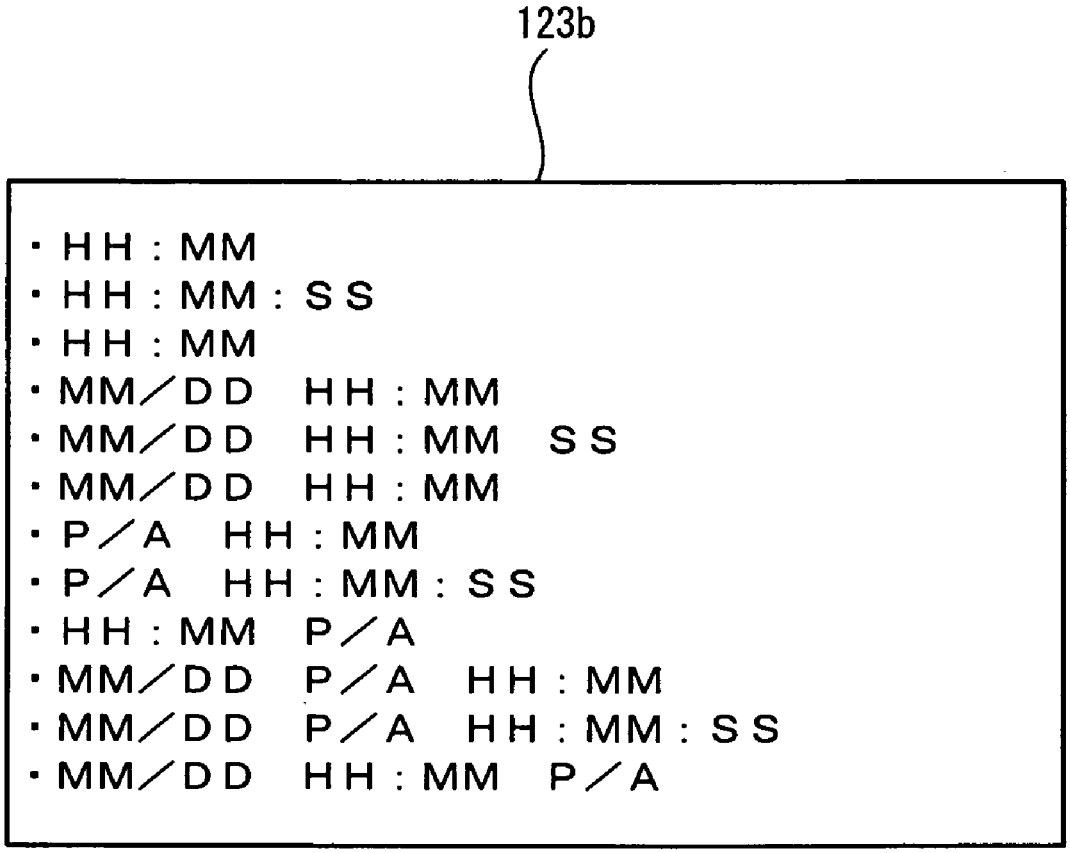
FIG. 8 is a schematic diagram illustrating a configuration of a 24-hour-system format storage area.

Specifically, as shown in FIGS. 7 and 8, the hour system format storage region 123 is configured by a 12-hour system format storage area 123*a* (see FIG. 7) in which a plurality of 12-hour system formats are stored and a 24-hour system format storage area 123*b* (see FIG. 8) in which a plurality of 24-hour system formats are stored. In each of the 12-hour system format storage area 123*a* and the 24-hour system format storage area 123*b*, the plurality of formats are arranged in a descending order of priorities. Therefore, in a default condition of the tape printer 1, a 12-hour system format of "P/A HH:MM" is set beforehand to be used and a 24-hour system format of "HH:MM" is set beforehand to be used. It should be noted that in FIGS. 7 and 8, "HH" gives a two-digit representation of hours, "MM" gives a two-digit representation of minutes, and "SS" gives a two-digit representation of seconds. "P/A" represents ante meridiem (AM) and post meridiem (PM) respectively and "MM/DD" gives a two-digit representation of months and a two-digit representation of days respectively.

Figure 9:
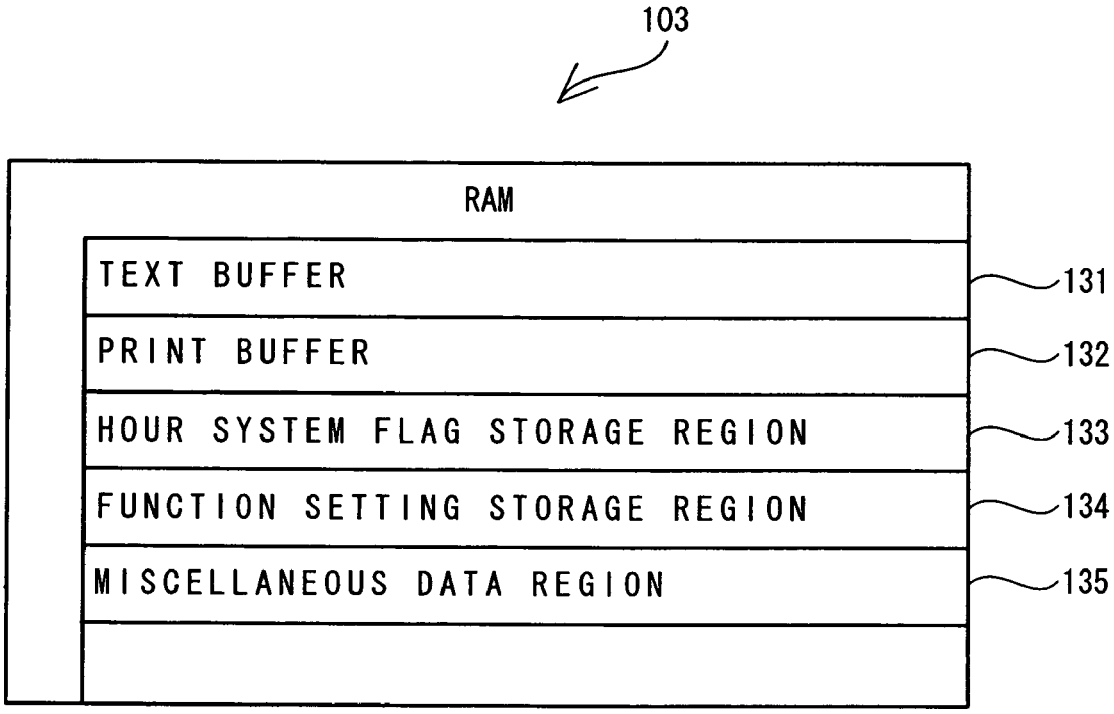
FIG. 9 is a schematic diagram illustrating a configuration of a RAM.

As shown in FIG. 9, the RAM 103 is comprised of a text buffer 131, a print buffer 132, an hour-system flag storage region 133, a function setting storage region 134, and a miscellaneous data region 135, etc. The text buffer 131 stores document data entered through the keyboard section 3. The print buffer 132 stores a plurality of printing dot patterns such as letters and symbols and number of pulses to be applied representing a dot formation energy quantity. The thermal head 11 is used to print dots in accordance with the dot pattern data stored in this print buffer 132.

The hour-system flag storage region 133 stores an hour system flag which indicates which of the 12-hour system or the 24-hour system is to be utilized for time display (time printing). It should be noted that if the hour system flag is set to "OFF" to indicate "0", the 12-hour system is to be used for time display (time printing), and if the hour system flag is set to "ON" to indicate "1", the 24-hour system is to be used for time display (time printing).

Further, the function setting storage region 134 stores settings regarding various functions such as display and printing of the tape printer 1. As will be described later, the function settings (e.g., language to be used and print format) stored in the function setting storage region 134, which can be changed arbitrarily by a user or a manufacturer, are set to a predefined default value (e.g., "English" as the language to be used) in an initial state.

In the tape printer 1 having such a configuration, when power is applied on it, based on the main control program stored in the ROM 102 (program storage region 122), the CPU 101 performs the later-described main processing (see FIG. 11). Subsequently, if letters, etc. are entered through the keyboard section 3 and printing is commanded, the texts (document data pieces) are sequentially stored into the text buffer 131 in the RAM 103 and, based on the a dot pattern generation control program and a display drive control program, dot patterns corresponding to the letters, etc. entered through the keyboard section 3 are displayed on the LCD section 4. Further, the thermal head 11 is driven by the head drive circuit 107 to print the dot pattern data stored in the print buffer 132, in synchronization with which the tape feed motor 37 conducts control on feeding of tape via the motor drive circuit 108. In this case, the thermal head 11 prints the letters, etc. on a tape by selectively driving heater elements via the head drive circuit 107 so that the selected heater elements may be heated corresponding to each line of print dots. Finally, the cutter mechanism 14 cuts off the tape as it is discharged from the tape discharge section 74, thereby creating each label strip.

Figure 10:
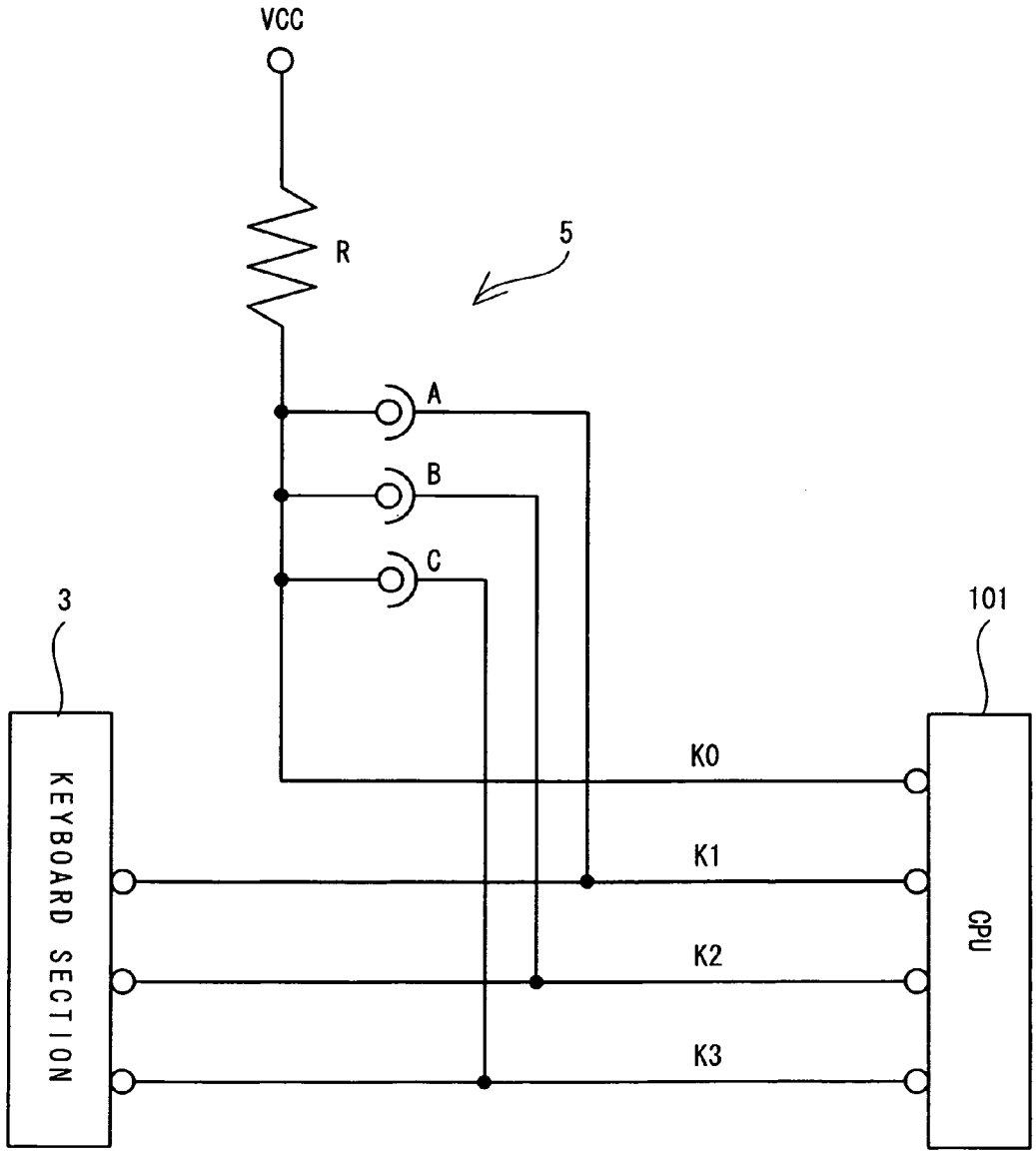
FIG. 10 is a configuration diagram of solder points that connect a CPU and a keyboard section to each other.

As shown in FIG. 10, in the tape printer 1 related to the present embodiment, the CPU 101 and the keyboard section 3 are connected to each other via the above-described solder points 5. That is, on the PCB of the control device 100, an interconnection KO connected to a power supply VCC via a resistor R is connected to the CPU 101, and to the interconnection KO the three solder points 5A, 5B, and 5C are also connected in parallel with each other. Further, the CPU 101 and the keyboard section 3 are connected to each other by three interconnections K1, K2, and K3. Out of these, the interconnections K0 and K1 can be interconnected via the solder point 5A, the interconnections K0 and K2 can be interconnected via the solder point 5B, and the interconnections K0 and K3 can be interconnected via the solder point 5C.

When the tape printer 1 is manufactured, based on the type of the keyboard section 3 (i.e., target country and district of the keyboard section 3), one of the solder points 5A, 5B and 5C is electrically connected by soldering. For example, if the solder point 5A is soldered, the interconnections K0 and K1 become conductive with each other, so that the CPU 101 can identify the type of the keyboard section 3 that corresponds to the solder point 5A. Similarly, if the solder point 5B is soldered, the interconnections K0 and K2 become conductive with each other, so that it can identify the type of the keyboard section 3 that corresponds to the solder point 5B. Further, if the solder point 5C is soldered, the interconnections K0 and K3 become conductive with each other, so that it can identify the type of the keyboard section 3 that corresponds to the solder point 5C.

It should be noted that in the present embodiment, for example, the target country (target district) of the keyboard section 3 corresponding to the solder point 5A is "USA", that corresponding to the solder point 5B is "France", and that corresponding to the solder point 5C is "Japan". In this case, the target country (target district) of the keyboard section 3 is "USA", so that it is assumed that the solder point 5A has been connected during manufacture of the tape printer 1.

Next, operations of the tape printer 1 having the above configuration are described with reference to FIGS. 11-18.

Figure 11:
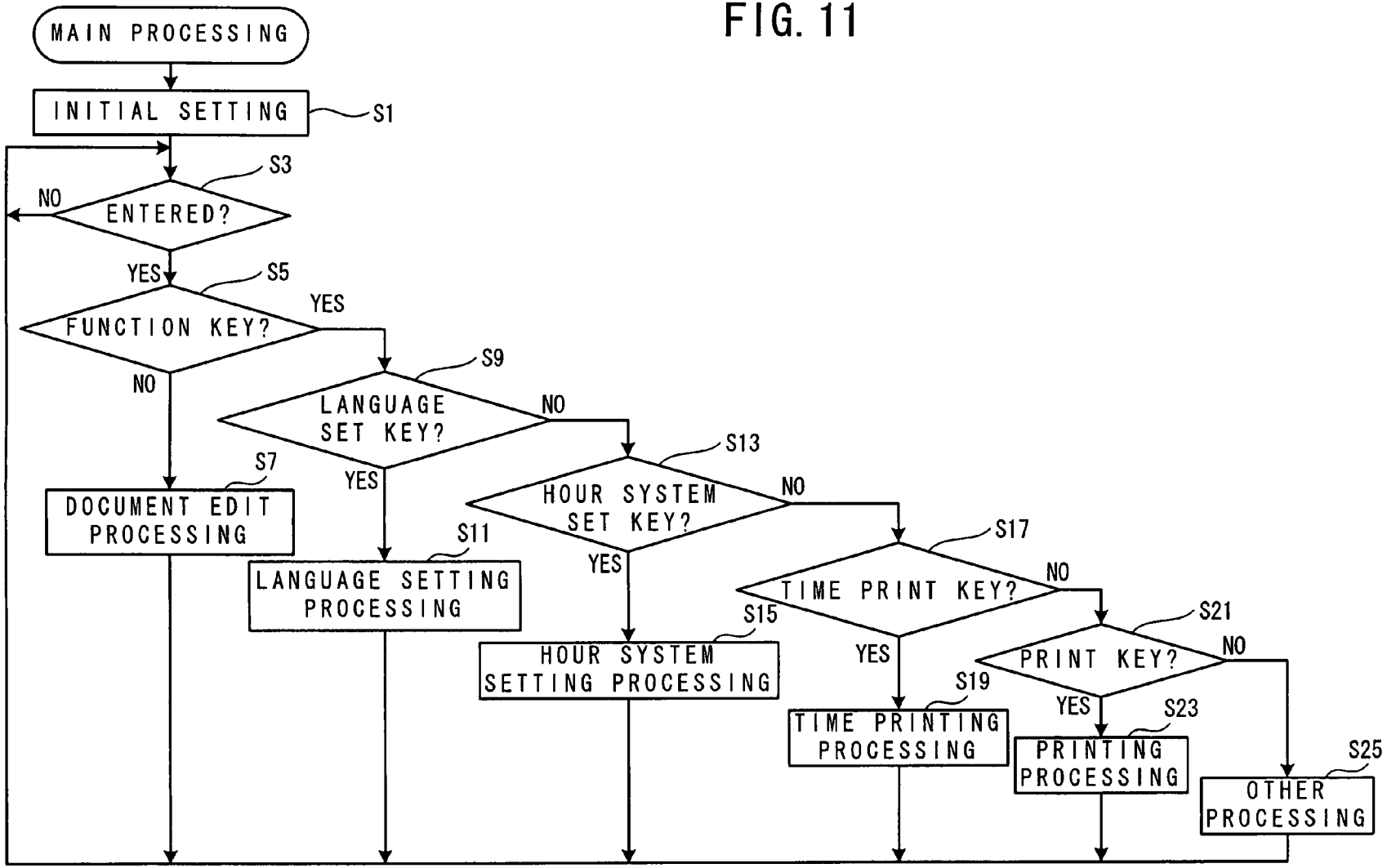
FIG. 11 is a main flowchart for the tape printer.
Figure 12:
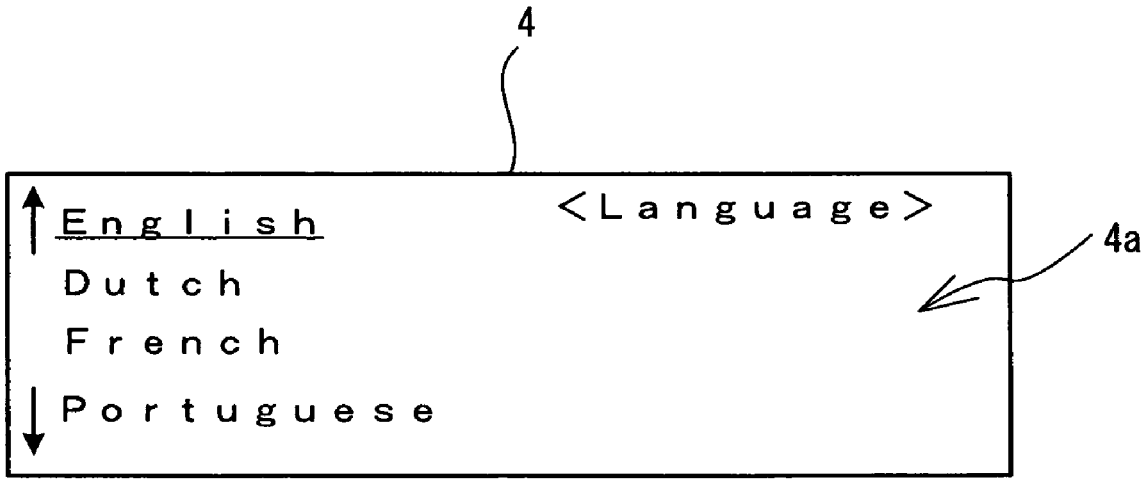
FIG. 12 is a diagram illustrating a specific example of a language setting screen.

When power is applied to the tape printer 1 to actuate it, as shown in FIG. 11, the process initializes a variety of initials values, flags, etc. (S1). Then, the process stays in a waiting state until entry is made through the keyboard section 3 (NO at S3). When something is entered through the keyboard section 3 (YES at S3) and if the pressed key 3A is not a "FUNCTION key" to set functions of the tape printer 1 (NO at S5), this key 3A must be a "CHARACTER key" to enter a letter or a symbol, so that the process performs document edit processing (S7). In the document edit processing at S7, a predetermined document edit screen appears on the LCD section 4, to enable a user to create an arbitrary document on the document edit screen by use of the "CHARACTER key".

On the other hand, if the pressed key 3A is a "FUNCTION key" to set the functions of the tape printer 1 (YES at S5), a predetermined function setting screen appears on the LCD section 4. In the present embodiment, this function setting screen displays thereon a plurality of function keys such as "LANGUAGE SET key", "HOUR SYSTEM SET key", "TIME PRINT key", and "PRINT key" in a command menu, to enable the user to select an arbitrary one of the functions keys by use of ten keys or cursor key, not shown.

If the "LANGUAGE SET key" is selected on the function setting screen (YES at S9), the process performs language setting processing to set a language to be used in display or printing in the tape printer 1 (S11). In the language setting processing at S11, a predetermined language setting screen appears on the LCD section 4, to enable the user to select an arbitrary language on the language setting screen. For example, a language setting screen 4*a* shown in FIG. 12 displays a menu of a plurality of languages such as "English", "Dutch, "French", and "Portuguese", to enable the user to select any one of the languages by use of the ten keys or cursor key, not shown. In this case, it is assumed that the user has selected "English" on the language setting screen 4*a* as a language to be used and this language "English" to be used has been set in the function setting storage region 134 in the RAM 103.

Figure 13:
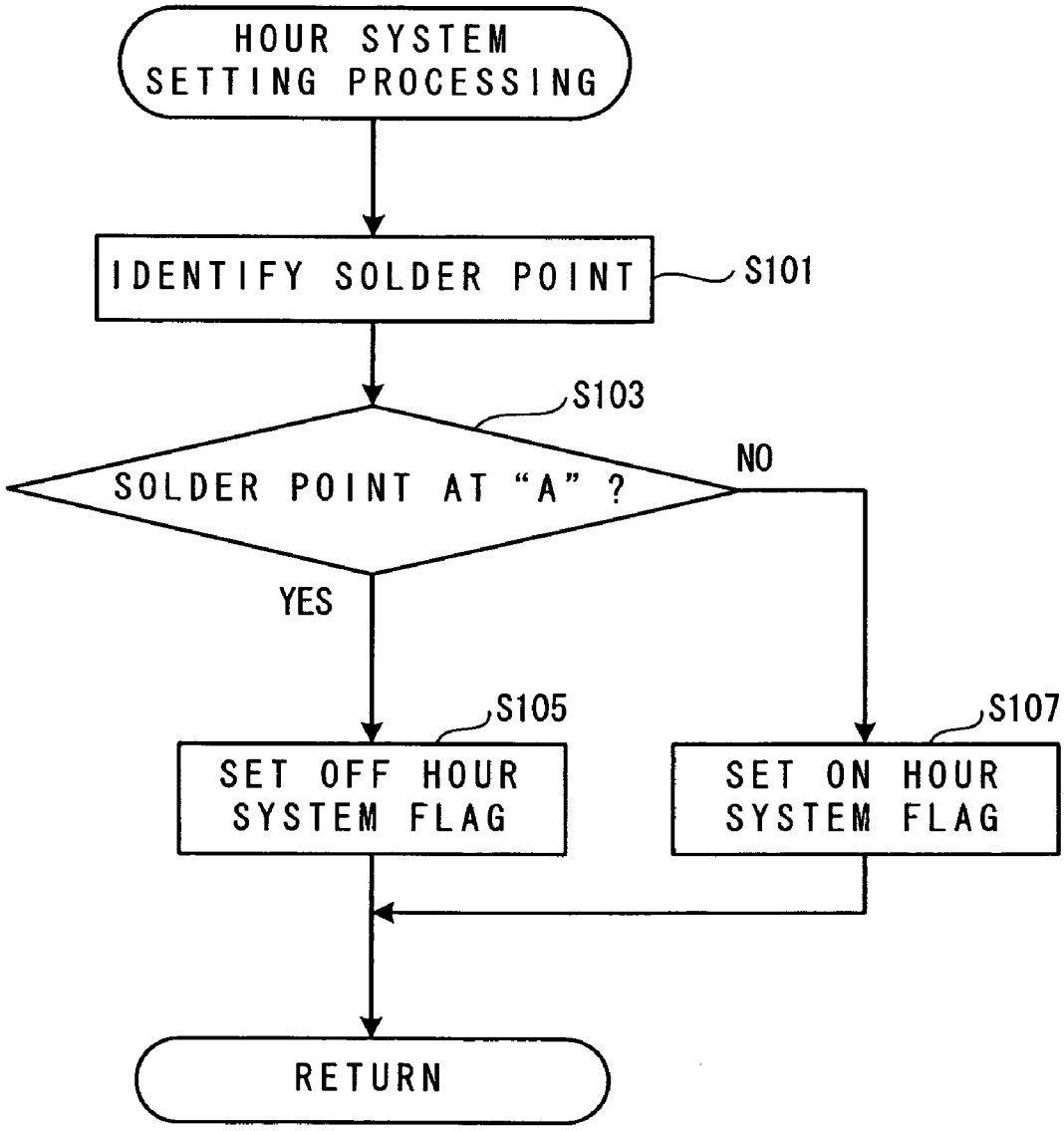
FIG. 13 is a flowchart illustrating details of hour system setting processing in the first embodiment.

Description is continued with reference back to FIG. 11. If the "HOUR SYSTEM SET key" is selected on the function setting screen (NO at S9, YES at S13), the process performs hour system setting processing to set an hour system to be used in the tape printer 1 (S15). As shown in FIG. 13, in the hour system setting processing of the present embodiment, first the process identifies which one of the solder points 5A, 5B, and 5C has been connected (S101). These solder points 5 can be identified on the basis of which one of the interconnections K0, K1, K2, and K3 is conductive. Then, the process decides whether the solder point 5A has been identified at S101 (S103). If the solder point 5A has been identified at S101 (YES at S103), the process sets to "OFF" the hour system flag to be stored in the hour system flag storage region 133 in the RAM 103, thus indicating "0" (S105). On the other hand, if the solder point 5B or 5C has been identified at S101 (NO at S103), the process sets this hour system flag to "ON", thus indicating "1" (S107).

Figure 14:
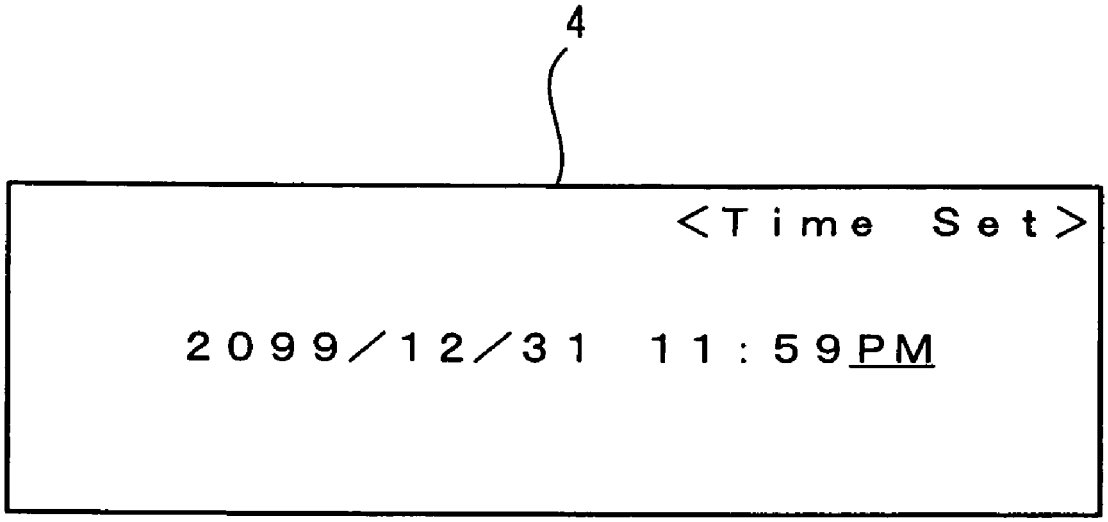
FIG. 14 is a specific example illustrating 12-hour-unit time display on a liquid crystal display section.
Figure 15:
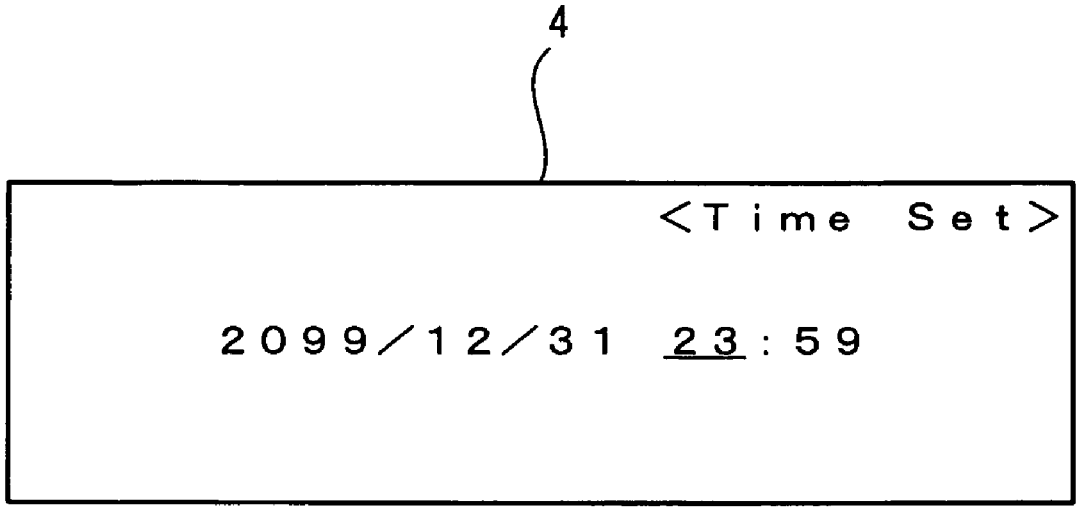
FIG. 15 is a specific example illustrating 24-hour-unit time display on a liquid crystal display section.

If the hour system flag is decided to be "0" as a result of this processing, the 12-hour system is used for time display (time printing) in the tape printer 1. For example, to display time on the LCD section 4 as shown in FIG. 14, time is displayed in 12-hour units by distinguishing between AM and PM. On the other hand, if the hour system flag is set to "1", the 24-hour system is used in time display (time printing) in the tape printer 1. For example, to display time on the LCD section 4 as shown in FIG. 15, time is displayed in 24-hour units without distinguishing between AM and PM. It should be noted that in the present embodiment the solder point 5A is connected in the tape printer 1 to set the target country (target district) of the keyboard section 3 to "USA", so that the hour system flag is set to "0" so that the 12-hour system may be used by the above processing. In such a manner, in the hour system setting processing (S15), it is possible to set an hour system that is optimal for the user based on the type of the keyboard section 3.

Figure 16:
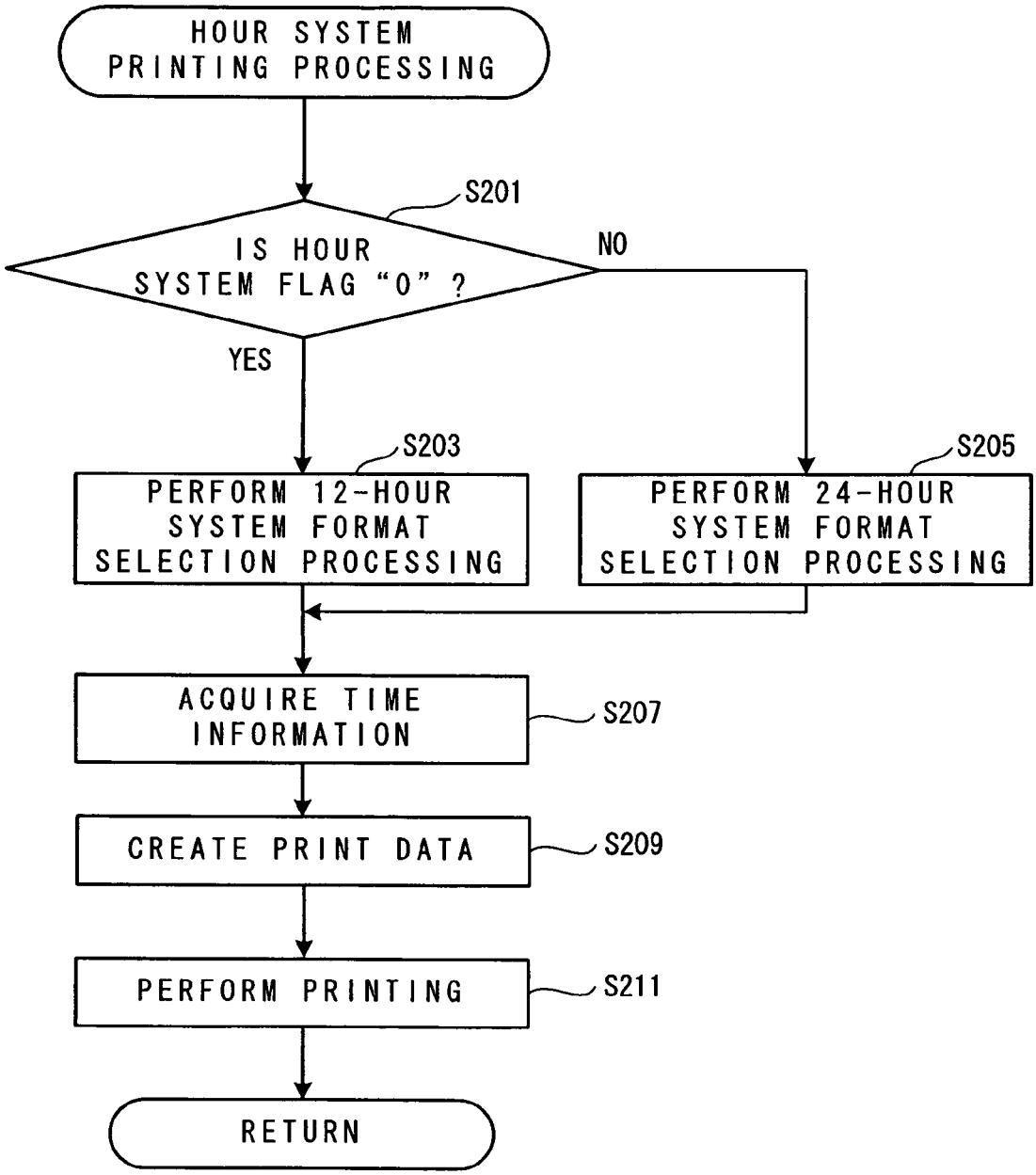
FIG. 16 is a flowchart illustrating details of time printing processing.
Figure 17:
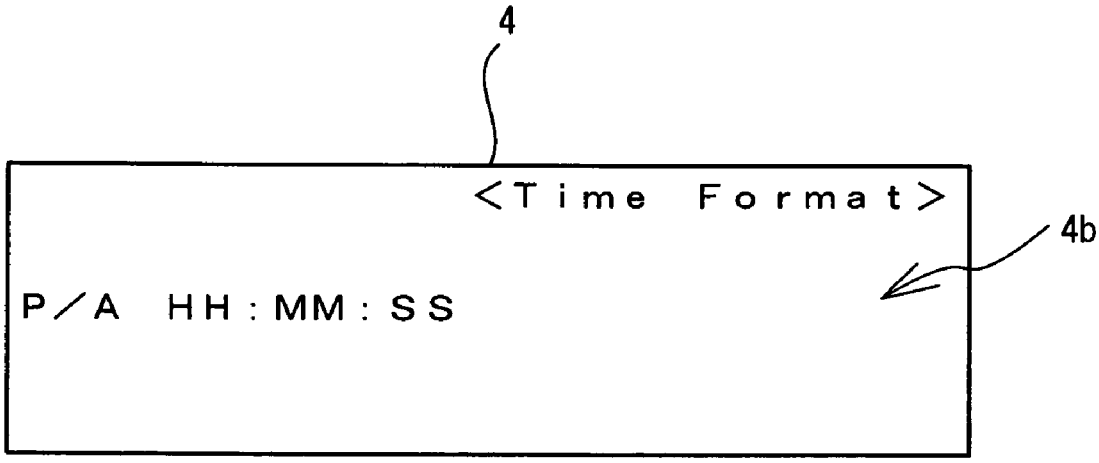
FIG. 17 is a diagram illustrating a specific example of a format setting screen.
Figure 18:
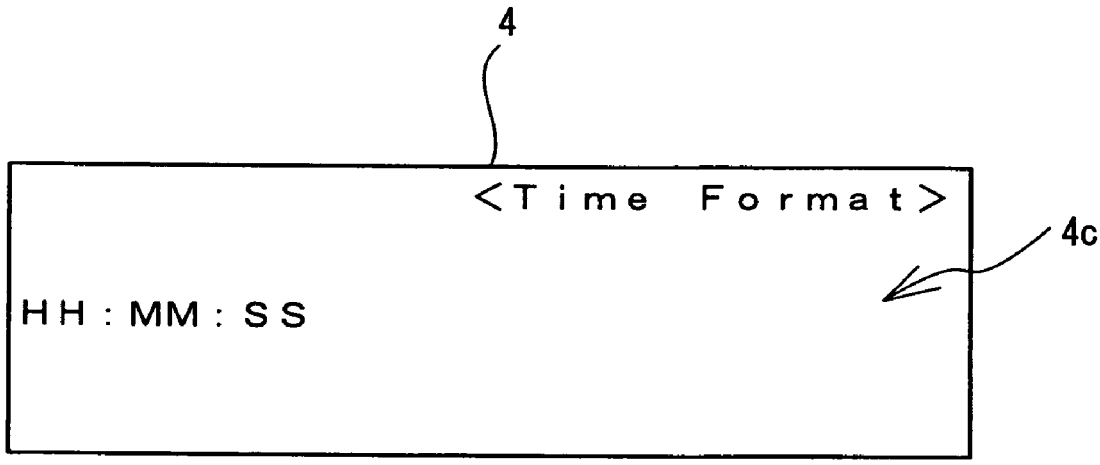
FIG. 18 is a diagram illustrating a specific example of another format setting screen.

Description is continued with reference back to FIG. 11. If the "TIME PRINT key" is selected on the function setting screen (NO at S13, YES at S17), the process performs time printing processing to print time measured by the tape printer 1 on the tape (S19). As shown in FIG. 16, in the time printing processing at S19, first the process decides whether the hour system flag stored in the hour system flag storage region 133 is "0" (S201). If the hour system flag has been set to "0" (YES at S201), the process performs 12-hour system format selection processing to select a print format from the 12-hour system format storage area 123*a* (see FIG. 7) (S203). In the 12-hour system format selection processing at S203, a predetermined format selection screen appears on the LCD section 4, to enable the user to select an arbitrary print format on this format setting screen. For example, on a format setting screen 4*b* shown in FIG. 17, the user can sequentially display a plurality of formats stored in the 12-hour system format storage area 123*a* by use of the ten keys and cursor key, not shown, and select an arbitrary one of the formats. It should be noted that if the user has not selected the 12-hour system at S203, the 12-hour system format having the highest priority (i.e., "P/A HH:MM") is selected as the print format.

On the other hand, if the hour system flag is decided to be "1" (NO at S201), the process performs 24-hour system format selection processing to select a format to be used from the 24-hour system format storage area 123*b* (see FIG. 8) (S205).

In the 24-hour system format selection processing at S205, a predetermined format selection screen appears on the LCD section 4, to enable the user to select an arbitrary print format on this format setting screen. For example, on a format setting screen 4*c* shown in FIG. 18, the user can sequentially display a plurality of formats stored in the 24-hour system format storage area 123*b* by use of the ten keys and cursor key, not shown, and select an arbitrary one of them. It should be noted that if the user has not selected the 24-hour system at S205, the 24-hour system format having the highest priority (i.e., "HH:MM") is selected as the print format.

The format selected at S203 or S205 is set as the print format in the function setting storage region 134 in the RAM 103. Then, the process acquires information of time measured by the RTC circuit 19 (S207) and, based on the print format selected at S203 or S205 and the time information acquired at S207, creates print data for time printing (S209). Finally, based on the print data created at S209, the process prints the time on the tape (S211). To describe it in detail, a dot pattern corresponding to the print data created at S209 is displayed on the LCD section 4 and, at the same time, printing of the dot pattern data by use of the thermal head 11 and control on feeding of tape by use of the tape feed motor 37 are performed in synchronization with each other. Accordingly, the time information corresponding to the print format is printed on the tape and, finally, the tape is cut off by the cutter mechanism 14 to create each label strip.

For example, if the user selects the 12-hour system format of "HH:MM P/A", "11:59 PM" is printed on the tape. On the other hand, if the user selects the 24-hour system format of "HH:MM:SS", time such as "23:59:19" is printed on the tape. In such a manner, at the time printing processing (S19), it is possible to print time based on the 12-hour system or the 24-hour system by use of an arbitrary print format.

Description is continued with reference back to FIG. 11. If the "PRINT key" is selected on the function setting screen (NO at S17, YES at S21), the process performs printing processing to print an intended letter or symbol on the tape (S23). To describe it in detail, a dot pattern corresponding to the letters, etc. stored in the text buffer 131 is displayed on the LCD section 4, and at the same time, printing of the dot pattern data by use of the thermal head 11 and control on feeding of tape by use of the tape feed motor 37 are performed in synchronization with each other. Accordingly, the target letters, etc. are printed on the tape and, finally, the tape is cut off by the cutter mechanism 14 to create each label strip.

It should be noted that if any other function key is selected on the function setting screen (NO at S21), other processing corresponding to this function key is performed (S25). Further, after processing of each of S7, S11, S15, S19, S23, and S25 is performed, the process returns to S3 to wait for the next entry.

As described above, according to the tape printer 1 related to the first embodiment, the solder point 5 has been detected through the keyboard section 3 connected to the tape printer 1 to identify a target country (target district) of the keyboard section 3 based on a result of this detection so that correspondingly time display (time printing) can be performed using either one of the 12-hour system and the 24-hour system. Therefore, it is possible to perform time display (time printing) in an hour system that is optimal for the user without need of performing operations required to switch between time display (time printing) by use of the 12-hour system and time display (time printing) by use of the 24-hour system.

Further, during performance of the time printing processing (S19), it has been made possible for the user to set an arbitrary print format from among a plurality of 12-hour system formats or a plurality of 24-hour system formats based on the hour system. It is thus possible to print time on a tape, on which information is to be recorded, in a print format that is optimal for the user.

The following will describe a second embodiment of the disclosure with reference to the drawings. A tape printer 1 related to the present embodiment is basically the same as that related to the first embodiment, except for a method of selecting an hour system which is used in time display (time printing). The following will describe respects different from the first embodiment.

First, in the case of the tape printer 1 related to the present embodiment, it is assumed that the following function setting (pre-shipment setting processing) has been performed when it is manufactured (before shipment of the product).

It supposed that in the pre-shipment setting processing of the tape printer 1, a manufacturer, etc. would set a variety of functions by use of a keyboard section 3 on a predetermined initial function setting screen which he displays on an LCD section 4. It should be noted that this processing may be performed by the manufacturer at an arbitrary timing after completion of the tape printer 1 product and before shipment thereof.

Figure 19:
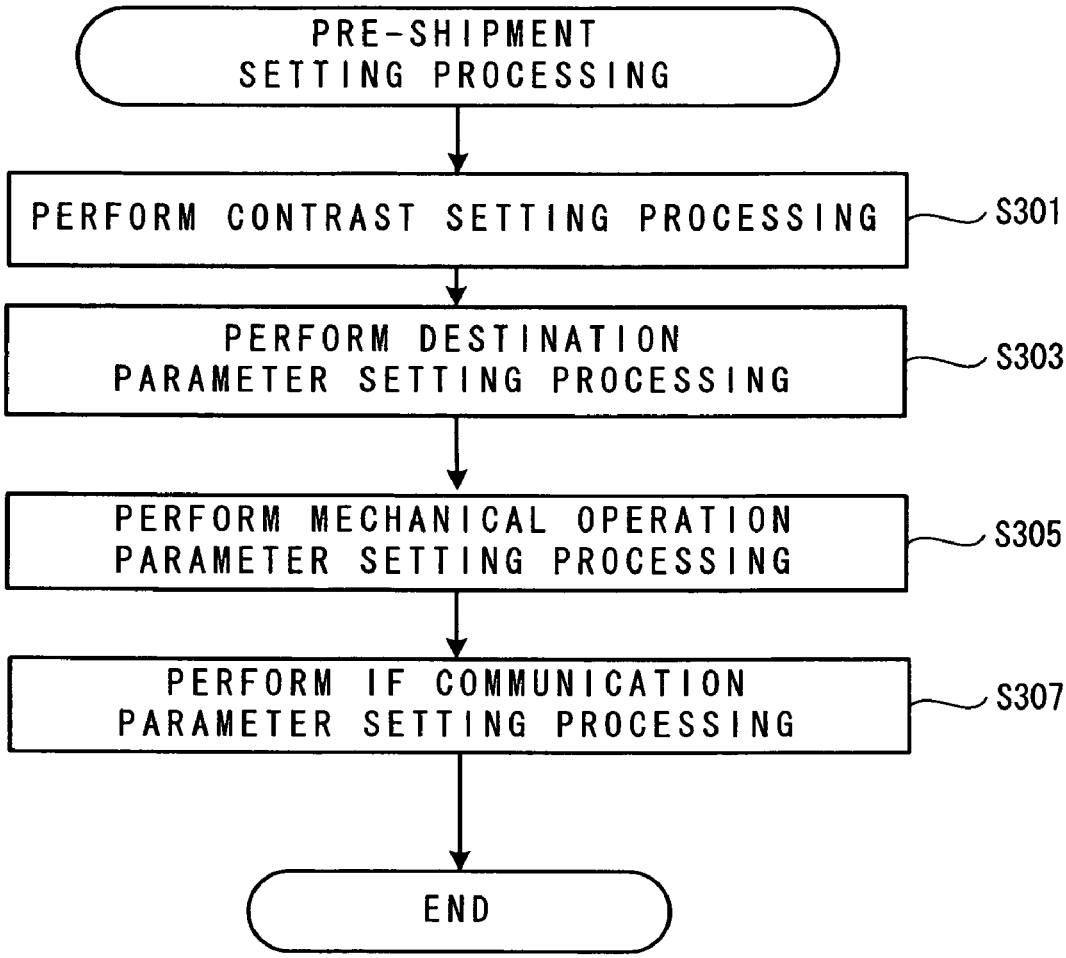
FIG. 19 is a main flowchart of pre-shipment setting processing in a second embodiment.

As shown in FIG. 19, in the pre-shipment setting processing of the tape printer 1, first the process performs contrast setting processing to set an initial value of a contrast (LD ratio) of the LCD section 4 (S301). In the contrast setting processing at S301, a contrast setting screen 4*d* such as the one shown in FIG. 20 appears on the LCD section 4, on which screen 4*d* the manufacturer can arbitrarily set a contrast of the LCD section 4.

Figure 21:
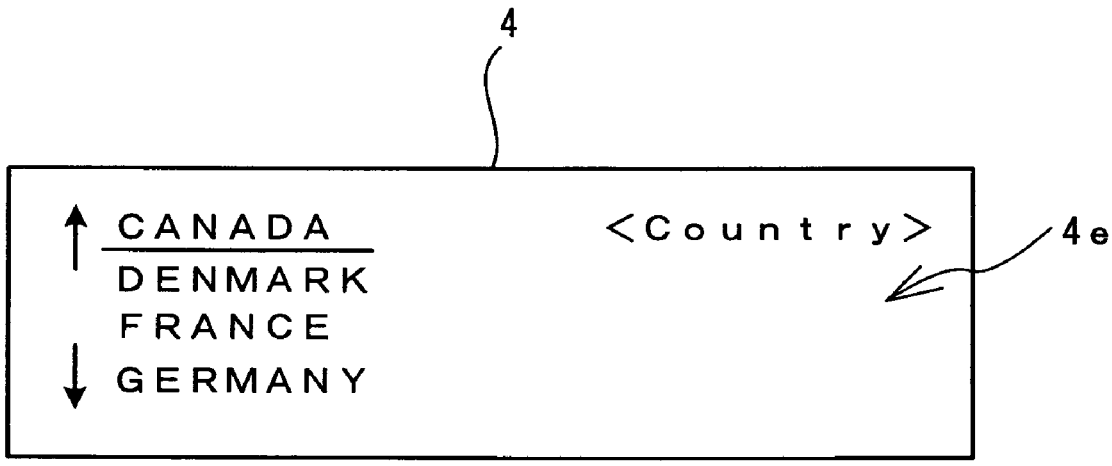
FIG. 21 is a diagram illustrating a specific example of a destination parameter setting screen.

Further, the process performs destination parameter setting processing to set a destination of the tape printer 1 (S303). In the destination parameter setting processing at S303, a destination parameter setting screen 4*e* such as the one shown in FIG. 21 appears on the LCD screen 4, on which screen 4*e* the manufacturer can arbitrarily set a destination of the tape printer 1. In the present embodiment, it is supposed that the manufacturer has selected "CANADA" as the destination of the tape printer 1 from among a plurality of preset candidate countries.

Figure 22:
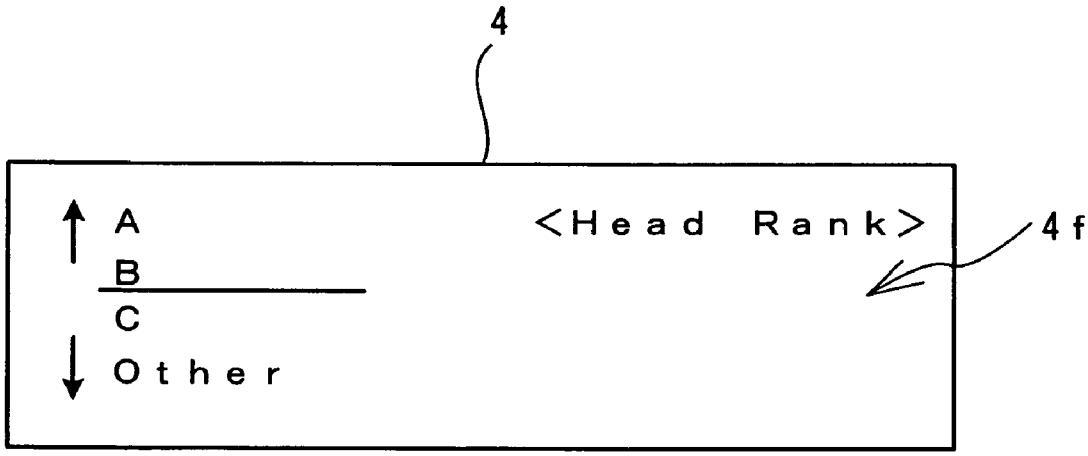
FIG. 22 is a diagram illustrating a specific example of a mechanical-operation parameter setting screen.

Further, the process performs mechanical operation parameter setting processing to set heat characteristics of a thermal head 11 (S305). In the mechanical operation parameter setting processing at S305, a mechanical operation parameter setting screen 4*f* such as the one shown in FIG. 22 appears on the LCD screen 4, on which screen 4*f* the manufacturer can arbitrarily set the heat characteristics of the thermal head 11.

Figure 23:
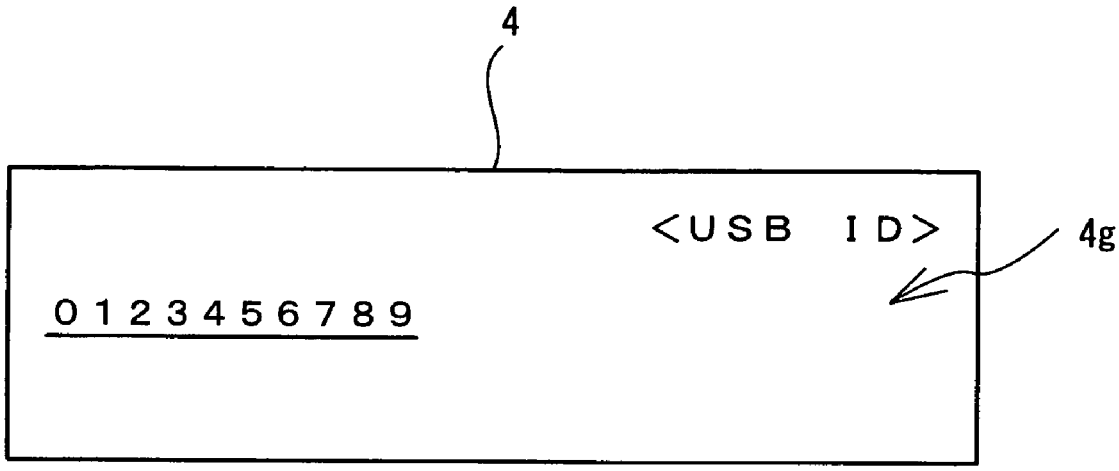
FIG. 23 is a diagram illustrating a specific example of an IF-communication parameter setting screen.

Further, the process performs IF communication parameter setting processing to set an ID number of a USB, not shown, of the tape printer 1 (S307). In the IF communication parameter setting processing at S307, an IF communication parameter setting screen 4*g* such as the one shown in FIG. 23 appears, on which screen 4*g* the manufacturer can arbitrarily set an ID number of the USB, not shown.

When the pre-shipment setting processing has thus been performed for the tape printer 1, the variety of initial functions are set in the tape printer 1, to enable it to be shipped to its destination. What has been set in S301 through S307 is stored in a function setting storage region 134 in the RAM 103. Upon initial actuation of the tape printer 1, a variety of operations are performed on the basis of the function settings stored in this function setting storage region 134.

Next, operations of the tape printer 1 on which the pre-shipment setting has thus been performed are described with reference to FIG. 24. The operations of the tape printer 1 related to the present embodiment are basically the same as those of the first embodiment (FIG. 11), except for contents of the above-described hour system setting processing (S15). The following will describe only respects that are different from those of the first embodiment (FIG. 11).

Figure 24:
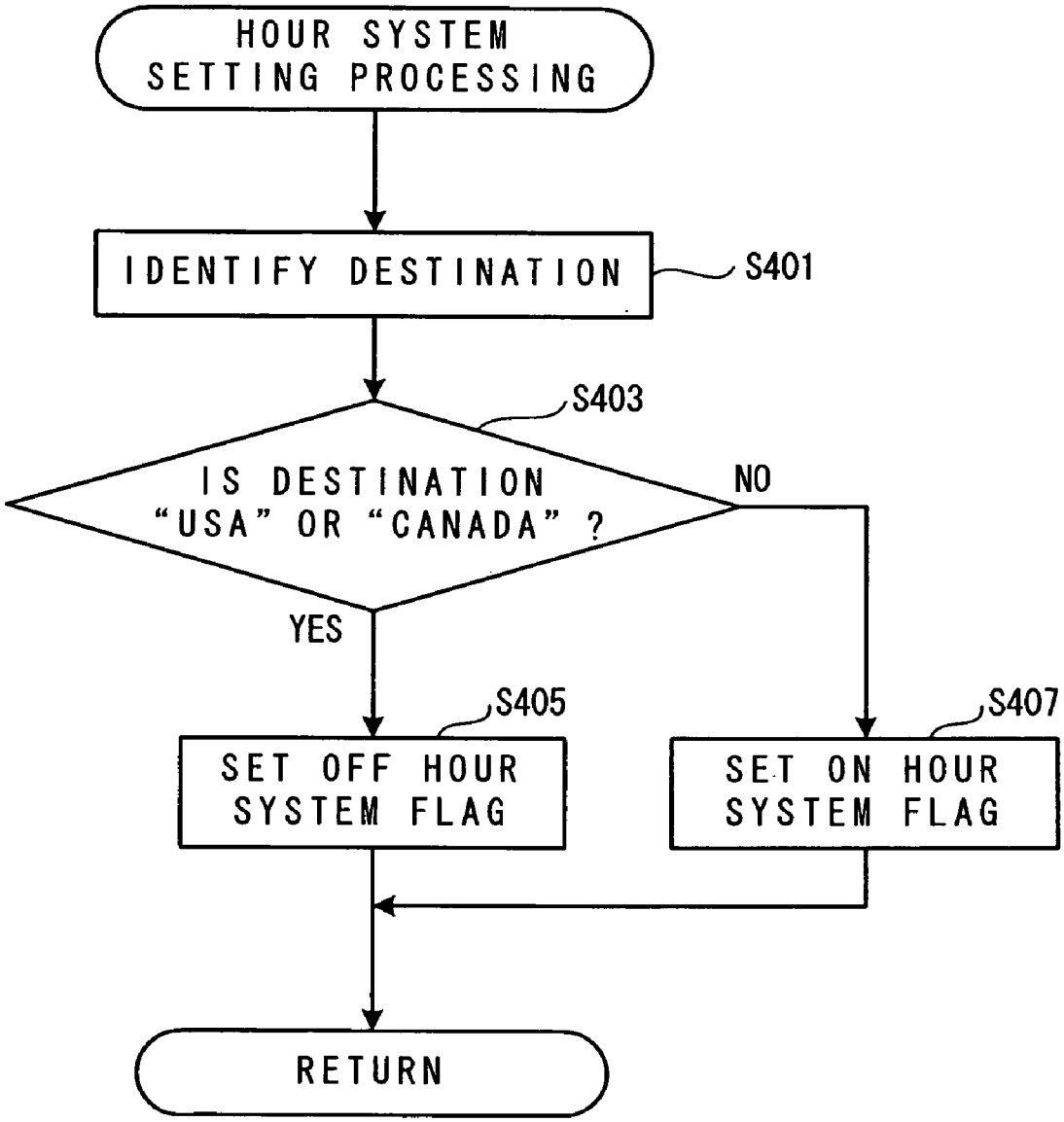
FIG. 24 is a flowchart illustrating details of hour system setting processing in the second embodiment.

As shown in FIG. 24, in the hour system setting processing of the present embodiment, first the process identifies a destination of the tape printer 1 (S401). This identification of the destination is performed by referencing a destination which has been set in the destination parameter setting processing (S303) in the pre-shipment setting processing (FIG. 19). Then, the process decides whether the destination identified at S401 is, for example "USA" or "CANADA", or not, in the present embodiment (S403). If the destination identified at S401 is "USA" or "CANADA" (YES at S403), the process sets to "OFF" an hour system flag which is stored in an hour system flag storage region 133, thus indicating "0" (S405). On the other hand, if the destination identified at S401 is any country other than "USA" or "CANADA" (NO at S403), the process sets this flag to "ON", thus indicating "1" (S407).

By the processing above, if the hour system flag is set to "0", the 12-hour system is used for time display (time printing) in the tape printer 1 (see FIG. 14). On the other hand, if the hour system flag is set to "1", the 24-hour system is used for time display (time printing) in the tape printer 1 (see FIG. 15). It should be noted that in the present embodiment, "CANADA" has been selected by the manufacturer as the destination of the tape printer 1, and therefore the hour system flag is set to "0" so that the 12-hour system may be used by the processing above. It is thus possible to automatically set an hour system that is optimal for a user in accordance with a destination of the tape printer 1 by use of the hour system setting processing (S15).

As described above, according to the tape printer 1 related to the second embodiment, a destination of the tape printer 1 which has been set arbitrarily by the manufacturer is identified so that correspondingly either the 12-hour system or the 24-hour system may be used to display time. Therefore, it is possible to perform time display (time printing) in an hour system that is optimal for the user without a need of operations required to switch the time display between the 12-hour time display system and the 24-hour time display system.

The following will describe a third embodiment of the disclosure with reference to the drawings. A tape printer 1 related to the present embodiment is basically the same as that related to the first embodiment and the second embodiment, except for a method of selecting an hour system which is used in time display (time printing). The following will describe respects that are different from the first embodiment and the second embodiment.

First, in the case of the tape printer 1 related to the present embodiment, it is assumed that the following function setting (pre-shipment setting processing) has been performed when it is manufactured (before shipment of the product). It is supposed that in the pre-shipment setting processing of the tape printer 1, a manufacturer, etc. would set a variety of functions by use of a keyboard section 3 on a predetermined initial function setting screen which he displays on an LCD section 4, so that this processing may be performed by the manufacturer at an arbitrary timing after completion of the tape printer 1 product and before shipment thereof.

Figure 25:
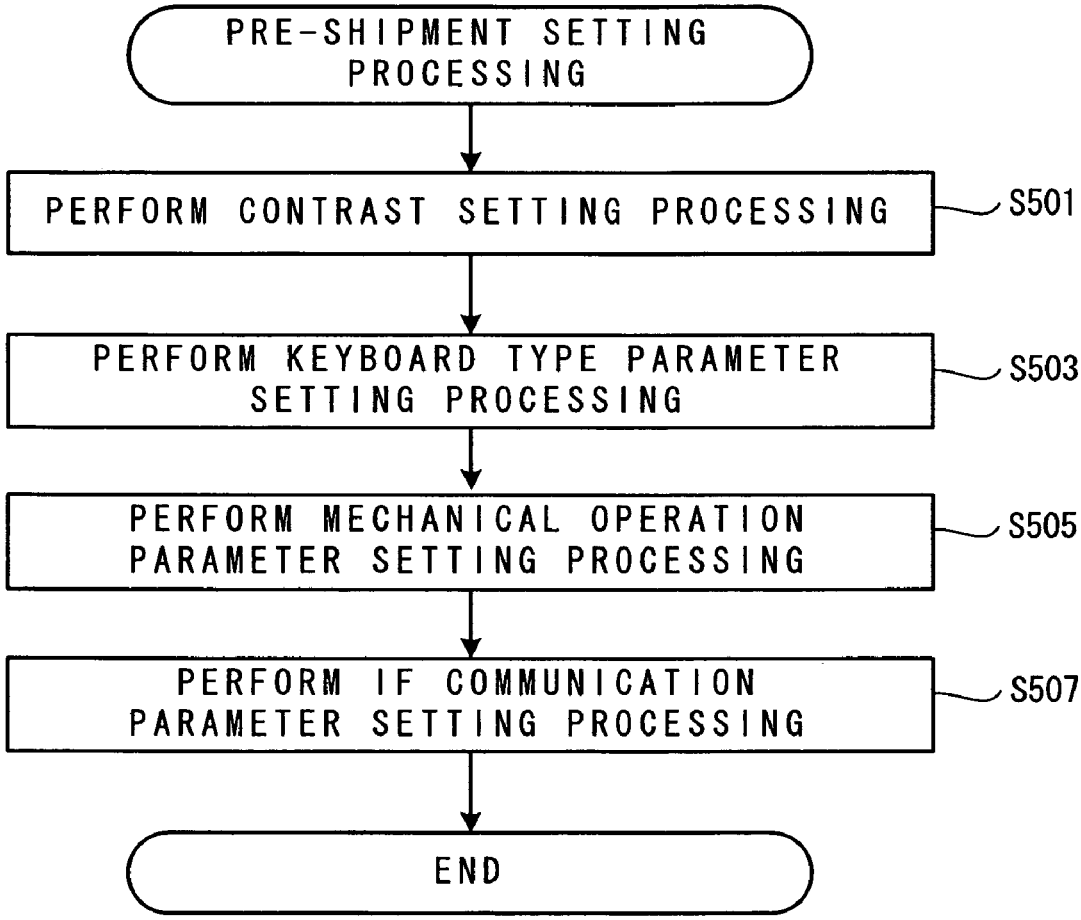
FIG. 25 is a main flowchart of pre-shipment setting processing in a third embodiment.
Figure 26:
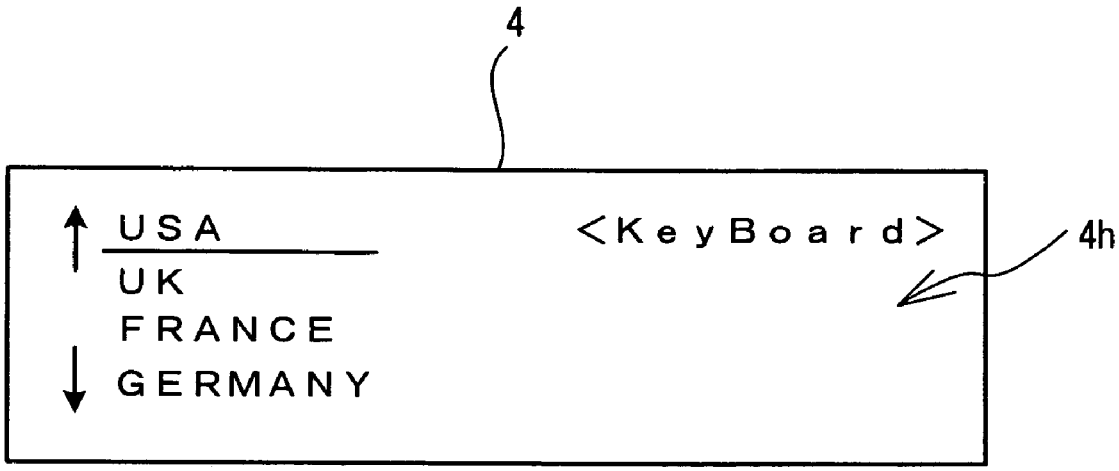
FIG. 26 is a diagram illustrating a specific example of a keyboard-type parameter setting screen.

As shown in FIG. 25, the pre-shipment setting processing of the tape printer 1 is performed in the same way as the second embodiment (FIG. 19) except that, instead of performing the destination parameter setting processing (S303), keyboard type parameter setting processing (S503) is carried out to set a type of the keyboard section 3 (i.e., a destination country or district of the keyboard section 3). In the keyboard type parameter setting processing at S503, a keyboard type parameter setting screen **4*h* such as the one shown in FIG. 26 appears on an LCD section 4, on which screen 4*h* the manufacturer can arbitrarily set a destination (destination district) of the keyboard section 3. In the present embodiment, it is supposed that the manufacturer has selected "USA" as the destination country (destination district) of the keyboard section 3** from among a plurality of preset keyboard types.

Figure 20:
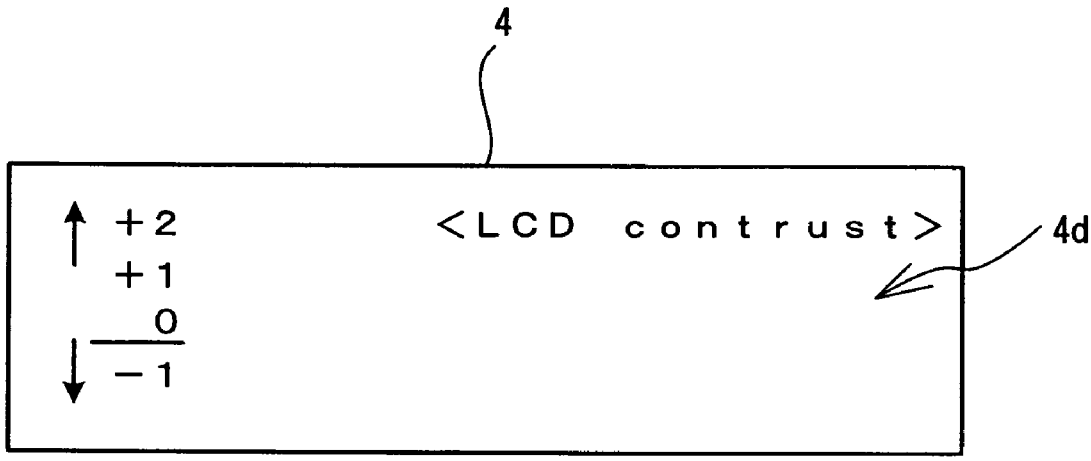
FIG. 20 is a diagram illustrating a specific example of a contrast setting screen.

It should be noted that contrast setting processing of S501 is the same as that in the second embodiment (see S301 of FIG. 19 and FIG. 20). Also, mechanical operation parameter setting processing of S505 is the same as that of the second embodiment (see S305 of FIG. 19 and FIG. 22). Further, IF communication parameter setting processing of S507 is the same as that of the second embodiment (see S307 of FIG. 19 and FIG. 23).

When the pre-shipment setting processing has thus been performed for the tape printer 1, a variety of initial functions are set in the tape printer 1, to enable it to be shipped to its destination. What has been set in S501 through S507 is stored in a function setting storage area, not shown, in the RAM 103. Upon initial actuation of the tape printer 1, a variety of operations are performed on the basis of the function settings stored in this function setting storage area, not shown.

Next, operations of the tape printer 1 on which the pre-shipment setting has thus been performed are described with reference to FIG. 27. The operations of the tape printer 1 related to the present embodiment are basically the same as those of the first embodiment (FIG. 11), except for contents of the above-described hour system setting processing (S15). The following will describe only respects that are different from those of the first embodiment (FIG. 11).

Figure 27:
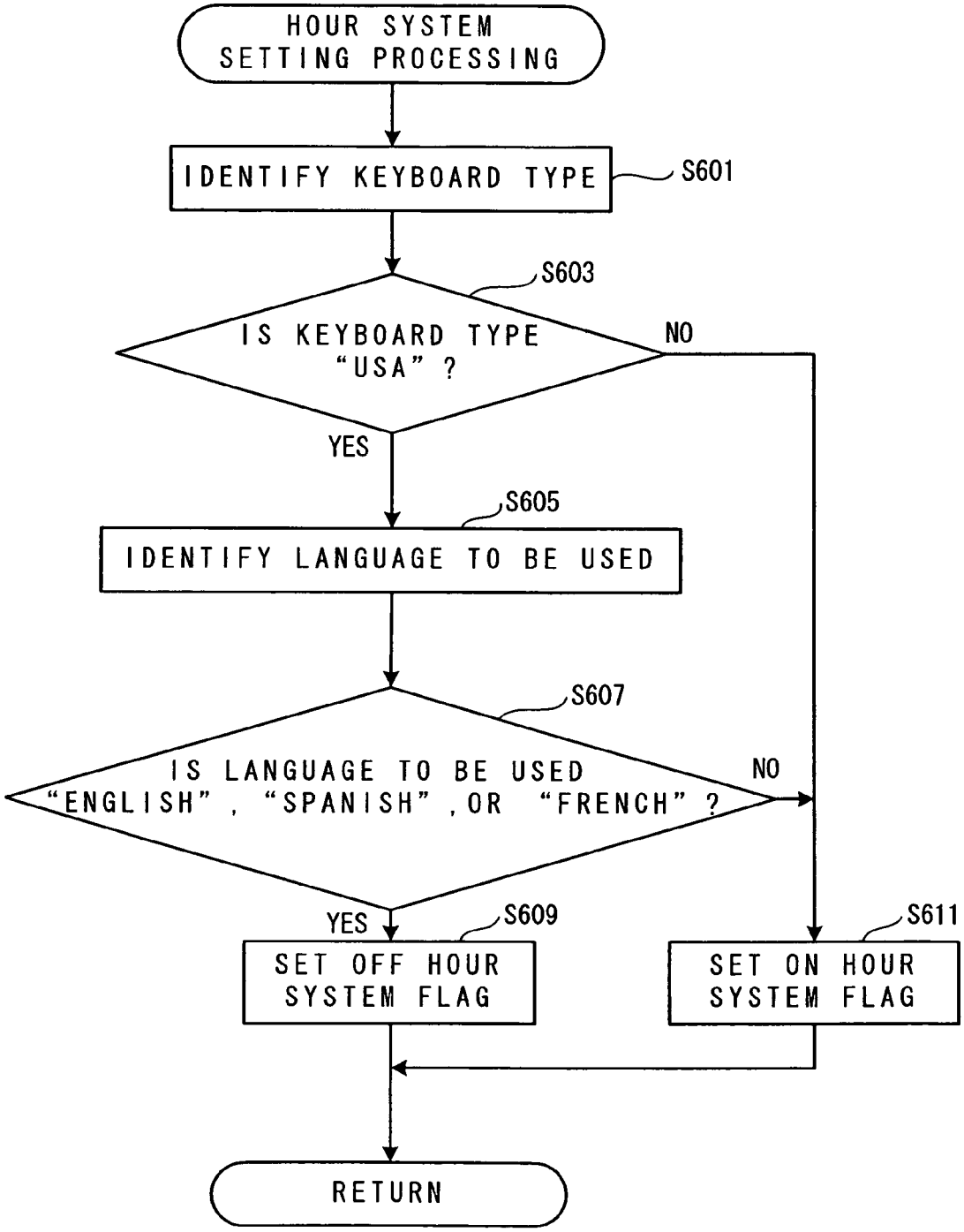
FIG. 27 is a flowchart illustrating details of hour system setting processing in the third embodiment.

As shown in FIG. 27, in the hour system setting processing of the present embodiment, first the process identifies a type of the keyboard section 3 (S601). This identification of the keyboard type is performed by referencing a keyboard type which has been set in the function setting storage area, not shown, in the RAM 103 by the keyboard type parameter setting processing (S503) in the above-described pre-shipment setting processing (FIG. 25). Then, the process decides whether the keyboard type identified at S601 is "USA" (S603).

If the keyboard type identified at S601 is "USA" (YES at S603), the process identifies a language to be used for the tape printer 1 (S601). This identification of the language to be used is performed by referencing a language to be used which has been set in the language setting processing (S11) in the main processing (FIG. 11). If the language to be used which has been identified at S605 is, for example, any one of "English", "Spanish", and "French" in the present embodiment (YES at S607), the process sets to "OFF" an hour system flag which is stored in an hour system flag storage region 133, thus indicating "0" (S609). On the other hand, if the keyboard type identified at S601 is any one other than "USA" (NO at S603) or if the keyboard type identified at S605 is none of "English", "Spanish", and "French" (NO at S607), the process sets this flag to "ON", thus indicating "1" (S611).

By the above processing, if the hour system flag is set to "0", the 12-hour system is used for time display (time printing) in the tape printer 1 (see FIG. 14). On the other hand, if the hour system flag is set to "1", the 24-hour system is used for time display (time printing) in the tape printer 1 (see FIG. 15). It should be noted that in the present embodiment, "USA" has been selected by the manufacturer as the target country (target district) of the keyboard section 3 and "English" has been selected by the user as the language to be used, so that the hour system flag is set to "0" so that the 12-hour system may be used by the processing above. It is thus possible to automatically set an hour system that is optimal for a user in accordance with a type of the keyboard section 3 and a language to be used for the tape printer 1 by use of the hour system setting processing (S15).

As described above, according to the tape printer 1 related to the third embodiment, a type of the keyboard section 3 which has been set arbitrarily by the manufacturer and a language to be used which has been set arbitrarily by the user are identified so that correspondingly either the 12-hour system or the 24-hour system may be used to display time. Therefore, it is possible to perform time display (time printing) in an hour system that is optimal for the user without a need of operations required to switch time display between the 12-hour time display system and the 24-hour time display system.

Of course, the invention is not limited to the above embodiments and can be changed and modified without deviating from a gist of the invention. Although the embodiments above have exemplified the tape printer 1 as a "electronic apparatus", the invention can be applied to various apparatuses such as a facsimile, a portable telephone, a personal computer, a TV set, a video apparatus, or a radio set as far as it has clock functions that control time display by use of the 12-hour system and the 24-hour system.

In the above embodiments, the "service environment" has referred to a target country (target district) in which the tape printer 1 is to be used, and if it is decided to be the USA or Canada, the 12-hour system would be used for time display (time printing). However, as far as whether to use the 12-hour system or the 24-hour system can be decided appropriately, any other information may be used as the "service environment". For example, in a case where the "service environment" is to refer to a nationality of the user of the tape printer 1 and if it is decided to be an American or a Canadian, the 12-hour system may be employed to perform time display (time printing).

Although the first embodiment has exemplified the keyboard section 3 as the "device that is connected or built in", the target country (target district) where the tape printer 1 is to be used may be decided on the basis of information which is detected from any other device such as the USB, not shown, or the tape cassette 51. Further, although the solder points 5 have been detected as the "environment information", a manufacturer's serial number of the keyboard section 3 or an identification number of the tape cassette 51 may be detected instead.

Although in the second embodiment, the manufacturer has arbitrarily set a destination of the tape printer 1 as the "service environment", the user may arbitrarily set the destination of the tape printer 1. That is, information necessary to decide whether the 12-hour system or the 24-hour system is to be used in the tape printer 1 may be set either by the user or the manufacturer.

Although in the third embodiment, whether the 12-hour system or the 24-hour system is to be used in the tape printer 1 has been decided on the basis of a combination of a "language to be used" set by the user and a "environment information" set by the manufacturer, it may be decided on the basis only of the "language to be used" or on the basis of the "environment information". Also, as described above, the "environment information" is not limited to the type of the keyboard section 3, and various kinds of information such as an ID number of the USB, not shown, or a manufacturer's serial number of the tape cassette 51 can be utilized as well.

Although in the above embodiments the hour system setting processing (S15) has been performed if the "HOUR SYSTEM SET key" has been selected, the hour system setting processing (S15) may be carried out at an arbitrary timing. Therefore, the hour system setting processing (S15) may be performed automatically upon start of actuation of the tape printer 1 (initial setting (S1)). It is thus possible for the tape printer 1 to carry out time display (time printing) in accordance with an hour system set by a user upon its actuation without a need of operations of the "HOUR SYSTEM SET key" by the user.

As described above, in an electronic apparatus having clock functions according to the disclosure, an environment in which the electronic apparatus is to be used has been identified so that correspondingly either the 12-hour system or the 24-hour system for time display might be selected, to display time in accordance with thus selected hour system. Therefore, it is possible to perform time display in an hour system that is optimal for the user without a need of operations required to switch between the 12-hour system and the 24-hour system for time display.

The electronic apparatus having clock functions of the disclosure has comprised a device that detects information regarding a service environment of any other devices connected to or built in it so that the service environment of the electronic apparatus might be identified on the basis of thus detected environment information. Therefore, it is possible to perform time display by use of the 12-hour system or the 24-hour system whichever appropriate in accordance with the environment information detected from the device connected to or built in the electronic apparatus.

The electronic apparatus having clock functions of the disclosure has comprised a device that sets a service environment arbitrarily so that thus arbitrarily set service environment might be identified as a service environment of the electronic apparatus. Therefore, it is possible to perform time display by use of the 12-hour system or the 24-hour system whichever appropriate in accordance with the service environment arbitrarily set by the user or the manufacturer.

The electronic apparatus having clock functions of the disclosure has comprised a device that arbitrarily sets a language to be used in display of information on a display device so that a service environment of the electronic apparatus might be identified on the basis of thus set language to be used. Therefore, it is possible to perform time display by use of the 12-hour system or the 24-hour system whichever appropriate in accordance with the language to be used which has been set arbitrarily by the user or the manufacturer.

The electronic apparatus having clock functions of the disclosure has comprised a device that arbitrarily sets information regarding a service environment of any other devices connected to or built in it and a device that arbitrarily sets a language to be used in information display on a display device so that a service environment of the electronic apparatus might be identified on the basis of thus set environment information and language to be used. Therefore, it is possible to perform time display by use of the 12-hour system or the 24-hour system whichever appropriate in accordance with the environment information and the language to be used which have been set arbitrarily by the user or the manufacturer.

A service environment of the electronic apparatus having clock functions of the disclosure is a target country or target district where the electronic apparatus is used. Therefore, it is possible to perform time display by use of the 12-hour system or the 24-hour system whichever appropriate in accordance with the target country or target district where the electronic apparatus is used.

In addition to the above effects of the disclosure, a printer of the disclosure prints information on a medium for recording thereon and has comprised a device that arbitrarily sets a print format which is used to print time. Therefore, it is possible to print time in a print format that is optimal for the medium for recording thereon.

A control program for an electronic apparatus having clock functions which is stored in a computer-readable medium of the disclosure has identified an environment in which the electronic apparatus is to be used, selected the 12-hour system or the 24-hour system to be used for time display based on thus identified service environment, and displayed time in accordance with thus selected hour system. Therefore, it is possible to perform time display in an hour system that is optimal for the user without a need of operations required to switch time display between the 12-hour time display system and the 24-hour time display system.

The electronic apparatus control program of the disclosure comprises a step of detecting information regarding a service environment of a device connected to or built in an electronic apparatus so that the service environment of the electronic apparatus may be identified on the basis of thus detected environment information. Therefore, it is possible to perform time display by use of the 12-hour system or the 24-hour system whichever appropriate in accordance with the environment information detected from the device connected to or built in the electronic apparatus.

The electronic apparatus control program of the disclosure comprises a step of arbitrarily setting a service environment so that thus arbitrarily set service environment may be identified as a service environment of an electronic apparatus. Therefore, it is possible to perform time display by use of the 12-hour system or the 24-hour system whichever appropriate in accordance with the service environment which is set by the user or the manufacture.

The electronic apparatus control program of the disclosure comprises a step of arbitrarily setting a language to be used in display of information so that a service environment of an electronic apparatus may be identified on the basis of thus set language to be used. Therefore, it is possible to perform time display by use of the 12-hour system or the 24-hour system whichever appropriate in accordance with the language which is set arbitrarily by the user or the manufacturer.

The electronic apparatus control program of the disclosure comprises steps of arbitrarily setting information regarding a service environment of a device connected to or built in an electronic apparatus and arbitrarily setting a language to be used in display of information so that a service environment of the electronic apparatus may be identified on the basis of thus set environment information and language to be used. Therefore, it is possible to perform time display by use of the 12-hour system or the 24-hour system whichever appropriate in accordance with the environment information and language which are set arbitrarily by the user or the manufacturer.

In the electronic apparatus control program of the disclosure, a service environment is a target country or target district where an electronic apparatus is used. Therefore, it is possible to perform time display by use of the 12-hour system or the 24-hour system whichever appropriate in accordance with the target country or target district where the electronic apparatus is used.

The electronic apparatus control program of the disclosure has comprised a printing step of printing information in a medium for recording thereon based on print data and a print format setting step of arbitrarily setting a print format which is used when printing measured time. Therefore, it is possible to print time in a print format that is optimal to the medium for recording thereon.

An electronic apparatus and a printer having clock functions of the disclosure can be utilized in a tape printer, etc. in which time display is controlled by use of the 12-hour system and the 24-hour system.

The control device or the CPU include an ASIC and PAL as indicated by the following additive description:

In the illustrated embodiment, the control device (CPU 101) preferably is implemented using a suitably programmed general purpose computer, e.g., a microprocessor, microcontroller or other processor device (CPU or MPU). It will be appreciated by those skilled in the art, that the controller also can be implemented as a single special purpose integrated circuit (e.g., ASIC) having a main or central processor section for overall, system-level control, and separate sections dedicated to performing various different specific computations, functions and other processes under control of the central processor section. The controller also can be implemented using a plurality of separate dedicated or programmable integrated or other electronic circuits or devices (e.g., hardwired electronic or logic circuits such as discrete element circuits, or programmable logic devices such as PLDs, PLAs, PALs or the like). The controller also can be implemented using a suitably programmed general purpose computer in conjunction with one or more peripheral (e.g., integrated circuit) data and signal processing devices. In general, any device or assembly of devices on which a finite state machine capable of implementing the described procedures can be used as the controller of the invention.

What is claimed is:

1. A tape printer having clock functions, comprising: a printing device used to print information on a medium for recording thereon based on print data, the printing device including a keyboard and a tape cassette providing the recording medium; a print format setting device required to set a print format to be used by the printing device; a time measurement device that measures time for the print device; a time display device that displays time measured by the time measurement device; a service environment identification device that identifies an environment in which the printer is to be used; an hour system selection device that selects either a 12-hour system or a-24-hour system for time display based on the service environment identified by the service environment identification device; a time display control device that causes the time display device to display the time measured by the time measurement device in accordance with an hour system selected by the hour system selection device: an environment information detection device that detects environment information regarding the service environment correlated to the keyboard electrically connected to the printer, wherein the service environment identification device identifies the service environment of the printer based on the environment information detected by the environment information detection device; and a plurality of solder points, each of the solder point corresponding to a possible, pre-determined service environment where the printer will be used, wherein one of the solder points is electrically connected to the environment information detection device thereby identifying to the environment information detection device the service environment where the printer will be used.

2. The printer according to claim 1, further comprising a service environment setting device that sets the service environment, wherein the service environment identification device identifies the service environment set by the service environment setting device as the service environment of the printer.

3. The printer according to claim 1, further comprising: a display device that displays information regarding the printer; and a language setting device that sets a language to be used in the information which is displayed on the display device, wherein the service environment identification device identifies the service environment of the printer based on the language to be used which has been set by the language setting device.

4. The printer according to claim 1, further comprising: a display device that displays information regarding the printer; a language setting device that sets a language to be used in the information which is displayed on the display device; and an environment information setting device that arbitrarily sets information regarding a service environment of a device connected to or built in the printer, wherein the service environment identification device identifies the service environment of the printer based on the environment information which has been set by the environment information setting device and the language to be used which has been set by the language setting device.

5. A tape printer having clock functions, comprising: a printing device that prints information on a medium for recording thereon based on print data, the printing device including a keyboard and a tape cassette providing the recording medium; a plurality of solder points, each of the solder points corresponding to a pre-determined service environment where the printer will be used, wherein one of an solder points is electrically connected to the environment information detection device thereby identifying to the environment information detection device the service environment where the printer will be used; a time measurement device that measures time; a time display device that displays time measured by the time measurement device; and a control device that: (i) identifies the service environment in which the printer is to be used; (ii) selects either a 12-hour system or a 24-hour system for time display based on the service environment identified; (iii) causes the time display device to display the time measured by the time measurement device in accordance with a hour system selected; (iv) sets a print format to be used by the printing device when printing time measured by the time measurement device; (v) detects environment information regarding the service environment correlated to the keyboard electrically connected to the printer; and identifies the service environment of the printer based on the detected environment information.

6. The printer according to claim 5, wherein the control device further: sets the service environment; and identifies a set service environment as a service environment of the printer.

7. The printer according to claim 5, further comprising a display device that displays information regarding the printer, wherein the control device further: sets a language to be used in information which is displayed on the display device; and identifies a service environment of the printer based on the set language to be used.

8. The printer according to claim 5, further comprising a display device that displays information regarding the printer, wherein the control device further: sets a language to be used in information which is displayed on the display device; sets information regarding a service environment of a device connected to or built in the printer; and identifies a service environment of the printer based on the set environment information and the set language to be used.

9. A control program for a tape printer having clock functions which is stored in a computer-readable medium, comprising: a time measurement step of measuring time; a service environment identification step of identifying an environment in which the printer is to be used; an environment information detection step of detecting environment information regarding a service environment correlating to a keyboard electrically connected to the printer, wherein the service environment identification step identifies the service environment of the printer based on the environment information detected by the environment information detection step; an hour system selection step of selecting either a 12-hour system or a 24-hour system for time display based on the service environment identified by the service environment identification step; and a time display control step of causing the time measured by an time measurement step to be displayed in accordance with the hour system selected by the hour system selection step; a printing step of printing information on a medium for recording thereon based on print data; and a print format setting step of setting a print format when printing time measured by the time measurement step, wherein the service environment identification step includes identifying an electrical connection established by one of a plurality of solder points disposed in the printer, each of the solder points corresponding to a pre-determined service environment where the printer will be used, thereby identifying the service environment to the printer control program.

10. The printer control program according to claim 9, comprising a service environment setting step of setting the service environment, wherein the service environment identification step identifies the service environment set by the service environment setting step as a service environment of the printer.

11. The printer control program according to claim 9, further comprising a language setting step of setting a language to be used when displaying information, wherein the service environment identification step identifies a service environment of the printer based on the language to be used which has been set by the language setting step.

12. The printer control program according to claim 9, further comprising: a language setting step of setting a language to be used when displaying information and an environment information setting step of setting information regarding a service environment of a device connected to or built in the printer, wherein the service environment identification step identifies a service environment of the printer based on the environment information set by the environment information setting step and the language to be used which has been set by the language setting step.

13. A tape printer having clock functions, comprising: a printing device used to print information on a medium for recording thereon based on print data, the printing device including a keyboard and a tape cassette providing the recording medium; a print format setting device required to set a print format to be used by the printing device; a time measurement device that measures time for the print device; a time display device that displays time measured by the time measurement device; a service environment identification device that identifies an environment in which the printer is to be used; an hour system selection device that selects either a 12-hour system or a-24-hour system for time display based on the service environment identified by the service environment identification device; a time display control device that causes the time display device to display the time measured by the time measurement device in accordance with an hour system selected by the hour system selection device; a display device that displays information regarding the printer; and a language setting device that sets a language to be used in the information which is displayed on the display device, wherein the service environment identification device identifies the service environment of the printer based on the language to be used which has been set by the language setting device.

14. A tape printer having clock functions, comprising: a printing device that prints information on a medium for recording thereon based on print data, the printing device including a keyboard and a tape cassette providing the recording medium; a display device that displays information regarding the printer; a time measurement device that measures time; a time display device that displays time measured by the time measurement device; and a control device that: (i) identifies an environment in which the printer is to be used; (ii) selects either a 12-hour system or a 24-hour system for time display based on the service environment identified; (iii) causes the time display device to display the time measured by the time measurement device in accordance with an hour system selected; and (iv) sets a print format to be used by the printing device when printing time measured by the time measurement device, wherein the control device further: sets a language to be used in information which is displayed on the display device; and identifies a service environment of the printer based on the set language to be used.

15. A control program for a tape printer having clock functions which is stored in a computer-readable medium, comprising: a time measurement step of measuring time; a service environment identification step of identifying an environment in which the printer is to be used; an hour system selection step of selecting either a 12-hour system or a 24-hour system for time display based on the service environment identified by the service environment identification step; a time display control step of causing the time measured by the time measurement step to be displayed in accordance with an hour system selected by the hour system selection step; a printing step of printing information on a medium for recording thereon based on print data; a print format setting step of setting a print format when printing time measured by the time measurement step; and a language setting step of setting a language to be used when displaying information, wherein the service environment identification step identifies the service environment of the printer based on the language to be used which has been set by the language setting step.

16. A tape printer having clock functions, comprising: a printing device used to print information on a medium for recording thereon based on print data, the printing device including a keyboard and a tape cassette providing the recording medium; a print format setting device required to set a print format to be used by the printing device; a time measurement device that measures time for the print device; a time display device that displays time measured by the time measurement device; a service environment identification device that identifies an environment in which the printer is to be used; an hour system selection device that selects either a 12-hour system or a-24-hour system for time display based on the service environment identified by the service environment identification device; a time display control device that causes the time display device to display the time measured by the time measurement device in accordance with an hour system selected by the hour system selection device; a display device that displays information regarding the printer; a language setting device that sets a language to be used in the information which is displayed on the display device; and an environment information setting device that sets information regarding the service environment of the keyboard electrically connected to the printer, wherein the service environment identification device identifies the service environment of the printer based on the environment information which has been set by the environment information setting device and the language to be used which has been set by the language setting device.

17. A tape printer having clock functions, comprising: a printing device that prints information on a medium for recording thereon based on print data, the printing device including a keyboard and a tape cassette providing the recording medium; a time measurement device that measures time; a time display device that displays time measured by the time measurement device; a control device that: (i) identifies the service environment in which the printer is to be used; (ii) selects either a 12-hour system or a 24-hour system for time display based on the service environment identified; (iii) causes the time display device to display the time measured by the time measurement device in accordance with an hour system selected; (iv) sets a print format to be used by the printing device when printing time measured by the time measurement device; and a display device that displays information regarding the printer, wherein the control device further: sets a language to be used in information which is displayed on the display device; sets information regarding a service environment of the keyboard electrically connected to the printer; and identifies the service environment of the printer based on the set environment information and the set language to be used.

18. A control program for a tape printer having clock functions which is stored in a computer-readable medium, comprising: a time measurement step of measuring time; a service environment identification step of identifying an environment in which the printer is to be used; an hour system selection step of selecting either a 12-hour system or a 24-hour system for time display based on the service environment identified by the service environment identification step; a time display control step of causing the time measured by the time measurement step to be displayed in accordance with an hour system selected by the hour system selection step; a printing step of printing information on a medium for recording thereon based on print data; a print format setting step of setting a print format when printing time measured by the time measurement step; a language setting step of setting a language to be used when displaying information; and an environment information setting step of setting information regarding a service environment of the printer, wherein the service environment identification step identifies the service environment of the printer based on the environment information set by the environment information setting step and the language to be used which has been set by the language setting step.

* * * * *